US007789641B2

(12) United States Patent
Masuda

(10) Patent No.: US 7,789,641 B2
(45) Date of Patent: Sep. 7, 2010

(54) ROTARY BLADE COMPRESSOR WITH ECCENTRIC AXIAL BIASING

(75) Inventor: Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/568,962

(22) PCT Filed: May 12, 2005

(86) PCT No.: PCT/JP2005/008723

§ 371 (c)(1),
(2), (4) Date: Feb. 21, 2006

(87) PCT Pub. No.: WO2005/111427

PCT Pub. Date: Nov. 24, 2005

(65) Prior Publication Data

US 2007/0031276 A1 Feb. 8, 2007

(30) Foreign Application Priority Data

May 14, 2004 (JP) ..... 2004-144675

(51) Int. Cl.
*F01C 1/02* (2006.01)

(52) U.S. Cl. ..... 418/59; 418/58

(58) Field of Classification Search ..... 418/56–62, 418/59

See application file for complete search history.

(56) References Cited

U.S. PATENT DOCUMENTS 2,073,101 A * 3/1937 Fox ..... 418/59
3,994,633 A * 11/1976 Shaffer ..... 418/5
4,992,032 A * 2/1991 Barito et al. ..... 418/55.4
5,085,565 A * 2/1992 Barito ..... 418/55.4
5,588,820 A * 12/1996 Hill et al. ..... 418/55.4
5,989,000 A * 11/1999 Tomayko et al. ..... 418/55.5
6,030,192 A * 2/2000 Hill et al. ..... 418/55.2
6,203,301 B1 * 3/2001 Kim ..... 418/59
6,290,478 B1 * 9/2001 Lifson ..... 418/55.4
6,893,234 B2 * 5/2005 Sun et al. ..... 418/55.5
2005/0031465 A1 2/2005 Dreiman et al.

FOREIGN PATENT DOCUMENTS

| | | |
|---|---|---|
| JP | 59-113289 | 6/1984 |
| JP | 60-90584 | 6/1985 |
| JP | 63-60091 | 4/1988 |
| JP | 03-172592 | 7/1991 |
| JP | 04-234589 | 8/1992 |
| JP | 06-159278 | 6/1994 |
| JP | 06-288358 | 10/1994 |
| JP | 07-063172 | 3/1995 |

(Continued)

*Primary Examiner*—Thomas Denion
*Assistant Examiner*—Douglas J. Duff
(74) *Attorney, Agent, or Firm*—Global IP Counselors

(57) ABSTRACT

A sealing ring is provided between an end plate of an eccentric rotation body and a support plate so that a pressure of fluid at high pressure is allowed to work on the end plate, thereby allowing an axial-direction pressing force to work on the end plate. The sealing ring is arranged eccentrically away from a center of a cylinder as forming the eccentric rotation body to minimize separation of the axial-direction pressing force from a thrust load in a radial direction in the end plate thereby reducing turnover moment effectively.

11 Claims, 12 Drawing Sheets

FOREIGN PATENT DOCUMENTS

| | | |
|---|---|---|
| JP | 07-229484 | 8/1995 |
| JP | 08-061257 | 3/1996 |
| JP | 08-247063 | 9/1996 |
| JP | 09-158849 | 6/1997 |
| JP | 09-310687 | 12/1997 |
| JP | 10-184567 | 7/1998 |
| JP | 11-190285 | 7/1999 |
| JP | 2000-104677 | 4/2000 |
| JP | 2003-184764 | 7/2003 |
| JP | 2004-060535 | 2/2004 |
| WO | WO02088529 | 11/2002 |

* cited by examiner

ROTARY BLADE COMPRESSOR WITH ECCENTRIC AXIAL BIASING

CROSS-REFERENCE TO RELATED APPLICATIONS

This U.S. National stage application claims priority under 35 U.S.C. §119(a) to Japanese Patent Application No. 2004-144675, filed in Japan on May 14, 2004, the entire contents of which are hereby incorporated herein by reference.

TECHNICAL FIELD

The present invention relates to a rotary compressor and more particularly relates to a rotary compressor including a cylinder having a cylinder chamber, a piston eccentrically accommodated in the cylinder chamber, and a pressing mechanism for bringing a cylinder side end plate and a piston side end plate close to each other.

BACKGROUND ART

As one of conventional rotary compressors including a compression mechanism in which a piston (an eccentric rotation body) rotates eccentrically within a cylinder chamber, there has been proposed a rotary compressor in which refrigerant is compressed by volume change of the cylinder chamber in association with eccentric rotation of an annular piston (for example, see Japanese Patent Publication No. 6-288358).

In the compressor (100), a hermetic casing (110) accommodates a compression mechanism (120) and a drive mechanism (an electric motor) (not shown) for driving the compression mechanism (20), as shown in FIG. 12 and FIG. 13 (a section taken along the line XIII-XIII in FIG. 12).

The compression mechanism (120) includes a cylinder (121) having an annular cylinder chamber (C1, C2) and an annular piston (122) arranged in the cylinder chamber (C1, C2). The cylinder (121) includes an outer cylinder (124) and the inner cylinder (125) which are arranged coaxially so that the cylinder chamber (C1, C2) is formed between the outer cylinder (124) and the inner cylinder (125). The outer cylinder (124) and the inner cylinder (125) are integrated by means of a cylinder side end plate (126A) provided at the top end faces thereof.

The annular piston (122) is connected to an eccentric portion (133*a*) of a drive shaft (133) connected to the electric motor through a piston base (piston side end plate) (126B) in substantially a circular shape so as to rotate eccentrically away from the center of the drive shaft (133). The annular piston (122) eccentrically rotates while being substantially in contact at one point of the outer peripheral face thereof with the inner peripheral face of the outer cylinder (124) (wherein, "substantially in contact" means a state in which though a minute gap is present to an extent that an oil film is formed, leakage of refrigerant in the gap is ignorable) and keeping substantially in contact at one point of the inner peripheral face 180° different in phase from the contact point with the outer peripheral face of the inner cylinder (125). Thus, an outer cylinder chamber (C1) and an inner cylinder chamber (C2) are formed on the outside and the inside of the annular piston (122), respectively.

An outer blade (123A) is arranged outside the annular piston (22). The outer blade (123A) is forced inward in the radial direction of the annular piston (122) so that the inner peripheral end thereof pushes and is in contact with the outer peripheral face of the annular piston (122). The outer blade (123A) divides the outer cylinder chamber (C1) into a high pressure chamber (a first chamber) (C1-Hp) and a low pressure chamber (a second chamber) (C1-Lp).

On the other hand, an inner blade (123B) is arranged inside the annular piston (123) on an extension line of the outer blade (123A). The inner blade (123B) is forced outward in the radial direction of the annular piston (122) so that the outer peripheral end thereof pushes and is in contact with the inner peripheral face of the annular piston (122). The inner blade (123B) divides the inner cylinder chamber (C2) into a high pressure chamber (a first chamber) (C2-Hp) and a low pressure chamber (a second chamber) (C2-Lp).

Further, in the outer cylinder (124), an intake port (141) for allowing the outer cylinder chamber (C1) to communicate with an intake pipe (114) provided at a casing (110) is formed in the vicinity of the outer blade (123A). Also, in the annular piston (122), a through hole (143) is formed in the vicinity of the intake port (141) so that the low pressure chamber (C1-Lp) of the outer cylinder chamber (C1) and the low pressure chamber (C2-Lp) of the inner cylinder chamber (C2) communicate with each other through the through hole (143). Further, a discharge port (not shown) for allowing the high pressure chambers (C1-Hp, C2-Hp) of the cylinder chambers (C1, C2) to communicate with a high pressure space (S) in the casing (110) is formed in the compression mechanism (120).

In the thus constructed compressor (100), when the drive shaft (133) rotates to eccentrically rotate the annular piston (122), volume expansion and contraction are repeated alternately in both the outer cylinder chamber (C1) and the inner cylinder chamber (C2). In the volume expansion of the respective cylinder chambers (C1, C2), a sucking process is performed in which the refrigerant is sucked into the respective cylinder chambers (C1, C2) from the intake port (141). While in the volume contraction, a compression process in which the refrigerant is compressed in the respective cylinder chambers (C1, C2) and a discharge process in which the refrigerant is discharged from the respective cylinder chambers (C1, C2) to the high pressure space (S) in the casing (110) through the discharge port are performed. Thus, the refrigerant at high pressure discharged in the high pressure space (S) of the casing (110) flows into a condenser of a refrigeration circuit through a discharge pipe (115) provided in the casing (110).

In the compressor (100) in this case, a support plate (117) for supporting the piston side end plate (126B) is formed at the lower face of the end plate (126B) connected to the annular piston (122). A sealing ring (129) is provided coaxially with the annular piston (122) at a part where the piston side end plate (126B) faces the support plate (117). The piston side end plate (126B) receives at a part thereof corresponding to the inner peripheral side of the sealing ring (129) pressure of the refrigerant in the high pressure space (S). This causes the piston side end plate (126B) to push upward in the axial direction towards the cylinder (121) to minimize gaps in the axial direction between the cylinder (121) and the annular piston (123) (a first axial-direction gap between the lower end face in the axial direction of the cylinder (121) and the piston side end plate (126B) and a second axial-direction gap between the upper end face in the axial direction of the piston (122) and the cylinder side end plate (126A)).

In the conventional construction as shown in FIG. 12 and FIG. 13, when pressure in the cylinder chambers (C1, C2) become high in the compression process, for example, gas force (a downward thrust load) in the axial direction is liable to work on the piston side end plate (126B) formed at the lower end of the annular piston (122). If the thrust load would become large or a point of action of the thrust load would be away from the axial center of the drive shaft (133), the piston side end plate (126B) and the annular piston (122) fixed to the end plate (126B) may incline (be turned over) with respect to the drive shaft (133) when a moment (a turnover moment) working on the piston side end plate (126B) exceeds a predetermined value. When a gap is generated between the annular piston (122) and the cylinder (121) by such turnover of the annular piston (122), the refrigerant leaks through the gap to lower the compression efficiency.

In the above conventional construction, the turnover moment caused due to the thrust load might be mitigated in such a manner that pressing force in the axial direction, which is obtained from the pressure at the part of the piston side end plate (126B) corresponding to the inner peripheral side of the sealing ring (129), works on the piston side end plate (126B) against the thrust load. However, the mitigation is insufficient because of the following reasons.

FIG. 14 is an explanatory drawing showing step by step eccentric motion of the annular piston (122) in the conventional construction. By driving the drive shaft (133), the annular piston (122) eccentrically rotates within the cylinder chamber (C1, C2) in the order shown in FIG. 14(A) to FIG. 14(D). When the annular piston (122) is in the state shown in FIG. 14(A), the pressure of the refrigerant in the high pressure chamber (C2-Hp) of the inner cylinder chamber (C2) rises to allow the center of the thrust load (PT) to move on the upper face of the piston side end plate (126B) towards the high pressure chamber (C2-Hp) in the radial direction, as shown by the arrow (PT) in FIG. 14. In contrast to the thrust load (PT), the pressing force (the arrow (P) in FIG. 14) obtained from the sealing ring (129) is centered on the center of the sealing ring (129) on the lower face of the piston side end plate (126B), in other words, on the center of the annular piston (122). This means that the point of action of the axial-direction pressing force (P) is different in the radial direction from the point of action of the thrust load (PT) working on the piston side end plate (126B), causing difficulty in effective mitigation of the turnover moment.

Further, in the state shown in FIG. 14(B) in which the inner pressure of the high pressure chamber (C2-Hp) of the inner cylinder chamber (C2) becomes high and the inner pressure of the high pressure chamber (C1-Hp) of the outer cylinder chamber (C1) becomes slightly high, the thrust load (PT) works on a part near the high pressure chambers (C1-Hp, C2-Hp) while the axial-direction pressing force (P) obtained from the sealing ring (129) works on a part near the low pressure chamber (C2-Lp), which is the center of the annular piston (122). Accordingly, the point of action of the axial-direction pressing force (P) further separates from the point of action of the thrust load (PT), inviting further difficulty in mitigation of the turnover moment.

In addition, in the state shown in FIG. 14(D) in which the inner pressure of the high pressure chamber (C1-Hp) of the outer cylinder chamber (C1) becomes high and the inner pressure of the high pressure chamber (C2-Hp) of the inner cylinder (C2) becomes slightly high, the thrust load (PT) is centered at a part near the high pressure chambers (C1-Hp, C2-Hp), resulting in separation of the point of action of the axial-direction pressing force (P) from the point of action of the thrust load (PT) to invite difficulty in effective mitigation of the turnover moment, as well.

As described above, in the conventional construction, the axial-direction pressing force (P) obtained from the sealing ring (129) hardly agrees with the thrust load (PT) in eccentric rotation of the annular piston (122), attaining ineffective restraint on turnover of the annular piston (122).

The present invention has been made in view of the above problems and has its objective of restraining turnover of an eccentric rotation body such as an annular piston by effectively exerting axial-direction force against a thrust load working on a end plate of the eccentric rotation body.

SUMMARY OF THE INVENTION

In the present invention, axial-direction pressing force to work on a end plate is made to work eccentrically from the center of an eccentric rotation body.

Specifically, a first aspect of the present invention provides a rotary compressor includes: a compression mechanism (20) including a cylinder (21) having a cylinder chamber (C) (C1, C2), a piston (22) accommodated in the cylinder chamber (C) (C1, C2) eccentrically with respect to the cylinder (21), and a blade (23) arranged in the cylinder chamber (C) (C1, C2) and defining the cylinder chamber (C) (C1, C2) into a first chamber (C-Hp) (C1-Hp, C2-Hp) and a second chamber (C-Lp) (C1-Lp, C2-Lp), at least one of the cylinder (21) and the piston (22) rotating eccentrically as an eccentric rotation body (21, 22); a drive shaft (33) for driving the compression mechanism (20); a pressing mechanism (60) for bringing a cylinder side end plate (26A), which is provided at one end in an axial direction of the cylinder chamber (C) (C1, C2) and faces an end face in an axial direction of the piston (22), and a piston side end plate (26B), which is provided at the other end in the axial direction of the cylinder chamber (C) (C1, C2) and faces an end face in an axial direction of the cylinder (21), close to each other in an axial direction of the drive shaft (33); and a casing (10) for accommodating the compression mechanism (20), the drive shaft (33), and the pressing mechanism (60), wherein the pressing mechanism (60) is eccentric away from the center of the end plate (26A, 26B) of the eccentric rotation body (21, 22), and the pressing mechanism (60) generates axial-direction pressing force of which center is eccentric away from the center of the drive shaft (33). Wherein, "a part eccentric from the center of the end plate (26A, 26B) of the eccentric rotation body (21, 22) and eccentric from the center of the drive shaft (33)" is shortened to "a part eccentric from the center of the end plate (26A, 26B) of the eccentric rotation body (21, 22)" in the following description.

In the first aspect of the present invention, the eccentric rotation body (21, 22) eccentrically rotates by the drive shaft (33) to change each volume of the first chamber (C-Hp) (C1-Hp, C2-Hp) and the second chamber (C-Lp) (C1-Lp, C2-Lp) in the cylinder chamber (C) (C1, C2), resulting in compression of to-be-processed fluid. In the compression, the pressing mechanism (60) brings the piston side end plate (26B) and the cylinder side end plate (26A) close to each other in the axial direction to minimize gaps in the axial direction between the piston (22) and the cylinder (21) (a first axial-direction gap between the end face in the axial direction of the cylinder (21) and the piston side end plate (26B) and a second axial-direction gap between the end face in the axial direction of the piston (22) and the cylinder side end plate (26A)).

In this first aspect of the present invention, the resultant force of the axial-direction pressing force obtained from the pressing mechanism (60) is centered at a part eccentric from the center of the end plate (26A, 26B) of the eccentric rotation body (21, 22). Thus, separation in the axial direction of the point of action of the axial-direction pressing force (P) from the point of action of the thrust load (PT) is restrained, which is the difference from the aforementioned conventional technique. As a result, the turnover moment caused due to the thrust load (PT) can be restrained effectively.

A second aspect of the present invention, is the rotary compressor of according to the first aspect of the present invention, wherein the cylinder chamber (C) is in a circular shape in section at a right angle in an axial direction, and the piston (22) is formed of a circular piston (22) arranged in the cylinder chamber (C). Wherein, "the section at a right angle in the axial direction" herein means a section at a right angle with respect to the drive shaft (the rotation center).

In the second aspect of the present invention, in the rotary compressor in which the cylinder chamber (C) has a circular shape in section at a right angle in the axial direction and the piston (22) is formed of a circular piston (22), the resultant force of the axial-direction pressing force obtained from the pressing mechanism (60) is centered at a part eccentric from the center of the end plate (26A, 26B) of the eccentric rotation body (21, 22), so that separation in the axial direction of the point of action of the axial-direction pressing force (P) from the point of action of the thrust load (PT) is restrained, restraining the turnover moment caused due to the thrust load (PT) effectively.

A third aspect of the present invention, is the rotary compressor of the first aspect of the present invention, wherein the cylinder chamber (C1, C2) is in an annular shape in section at a right angle in an axial direction, and the piston (22) is formed of an annular piston (22) arranged in the cylinder chamber (C1, C2) and defining the cylinder chamber (C1, C2) into an outer cylinder chamber (C1) and an inner cylinder chamber (C2).

In the third aspect of the present invention, the annular piston (22) is arranged in the annular cylinder chamber (C1, C2) to form an outside cylinder chamber (the outer cylinder chamber) (C1) between the wall face on the outer peripheral side of the cylinder chamber (C1, C2) and the outer peripheral face of the annular piston (22) and an inside cylinder chamber (the inner cylinder chamber) (C2) between the wall face on the inner peripheral side of the cylinder chamber and the inner peripheral face of the annular piston (22). As a result, the rotary compressor can be attained in which the to-be-processed fluid is compressed by alternate repetition of volume expansion and contraction in both the outer cylinder chamber (C1) and the inner cylinder chamber (C2), similarly to the aforementioned conventional rotary compressor.

In this third aspect of the present invention, similarly to the first and second aspects of the present inventions, the resultant force of the axial-direction pressing force obtained from the pressing mechanism (60) is centered at a part eccentric from the center of the end plate (26A, 26B) of the eccentric rotation body (21, 22), so that separation in the axial direction of the point of action of the axial-direction pressing force (P) from the point of action of the thrust load (PT) is restrained, resulting in effective restraint on the turnover moment caused due to the thrust load (PT).

A fourth aspect of the present invention, in is the rotary compressor of the third aspect of the present invention, wherein the piston (22) is in a C-shape into which a part of an annular shape is divided, a swing bush (27) is provided so as to be slidably held at the divided part of the piston (22), a blade groove (28) being formed therein for holding a blade (23) so as to allow the blade (23) to move back and forth, and the blade (23) is inserted in the blade groove (28) so as to extend from a wall face on an inner peripheral side to a wall face on an outer peripheral side of the annular cylinder chamber (C1, C2).

In the fourth aspect of the present invention, when at least one of the cylinder (21) and the piston (22) eccentrically rotates as the eccentric rotation body (21, 22), the blade (23) moves back and forth with the face thereof being in face contact with the blade groove (28) in the swing bush (27) while the swing bush (27) rocks with the face thereof being in face contact with the divided part of the piston (22). Thus, the cylinder chambers (C1, C2) can be divided into first chambers (C1-Hp, C2-Hp) and second chambers (C2-Lp, C2-Lp) while the blade (23) moves smoothly in the eccentric rotation of the eccentric rotation body (21, 22).

A fifth aspect of the present invention, is the rotary compressor of the first aspect of the present invention, wherein discharge ports (45, 46) for discharging fluid compressed in the cylinder chamber (C1, C2) to outside of the compression mechanism (20) are formed in the compression mechanism (20), and the pressing mechanism (60) generates the axial-direction pressing force of which center is eccentric to the discharge ports (45, 46) away from the center of the end plate (26A, 26B) of the eccentric rotation body (21, 22).

In the fifth aspect of the present invention, the to-be-processed fluid at high pressure by compression in, for example, the first chambers (C1-Hp, C2-Hp) is discharged outside the compression mechanism (20) through the discharge ports (45, 46).

In this fifth aspect of the present invention, the center of the resultant force of the axial-direction pressing force is set at a part near the discharge ports (45, 46) in the end plate (26A, 26B) of the eccentric rotation body (21, 22) where the to-be-processed fluid is liable to be at high pressure and where the thrust load (PT) working on the end plate (26A, 26B) of the eccentric rotation body (21, 22) is liable to be large. Accordingly, the point of action of the axial-direction pressing force (P) readily agrees with the point of action of the thrust load (PT) in the axial direction, with a result that the turnover moment caused due to the thrust load (PT) can be restrained further effectively.

A sixth aspect of the present invention, is the rotary compressor of the first aspect of the present invention, wherein a support plate (17) is arranged along a face opposite a face on the cylinder chamber (C1, C2) side of the end plate (26A, 26B) of the eccentric rotation body (21, 22) in the casing (10), a sealing ring (29) for defining an opposing part (61, 62) between the end plate (26A, 26B) and the support plate (17) inside and outside in a radial direction into a first opposing section (61) and a second opposing section (62) is arranged eccentrically away from the center of the eccentric rotation body (21, 22) in one of the end plate (26A, 26B) of the eccentric rotation body (21, 22) and the support plate (17), and the pressing mechanism (60) allows pressure of fluid discharged outside the compression mechanism (20) to work on the first opposing section (61) in the end plate (26A, 26B).

In the sixth aspect of the present invention, the sealing ring (29) is provided between the end plate (26A, 26B) of the eccentric rotation body (21, 22) and the support plate (17) to partition an opposing part between the end plate (26A, 26B) of the eccentric rotation body (21, 22) and the support plate (17) into two or more opposing sections (61, 62). The fluid at high pressure in the compression mechanism (20) is introduced into the first opposing section (61) and the pressure of the fluid is allowed to work on the first opposing section (61) in the end plate (26A, 26B) of the eccentric rotation body (21, 22), thereby obtaining the axial-direction pressing force against the end plate (26A, 26B) of the eccentric rotation body (21, 22).

In the sixth aspect of the present invention, the sealing ring (29) is provided at a part eccentric from the center of the eccentric rotation body (21, 22), so that the axial-direction pressing force obtained from the sealing ring (29) is centered at a part eccentric from the center of the end plate (26A, 26B) of the eccentric rotation body (21, 22). This restrains separation of the point of action of the axial-direction pressing force (P) from the point of action of the thrust load (PT), as described above.

A seventh aspect of the present invention, is the rotary compressor of the sixth aspect of the present invention, wherein the sealing ring (29) is fitted in an annular groove (17*b*) formed in one of the eccentric rotation body (21, 22) and the support plate (17).

In the seventh aspect of the present invention, the sealing ring (29) is fitted in the annular groove (17*b*), thereby being held securely at a position eccentric from the center of the eccentric rotation body (21, 22).

An eighth aspect of the present invention, is the rotary compressor of the first aspect of the present invention, wherein a slit (63) is formed at a part eccentric away from the center of the eccentric rotation body (21) in a face portion opposite a face on the cylinder chamber (C1, C2) side of the end plate (26A) of the eccentric rotation body (21), and the pressing mechanism (60) allows pressure of fluid discharged outside the compression mechanism (20) to work on the slit (63).

In the eighth aspect of the present invention, the pressure of the fluid at high pressure in the compression mechanism (20) is allowed to work on the slit (63) to cause the axial-direction pressing force (P) to readily work in the vicinity of the slit (63) in the end plate (26A) of the eccentric rotation body (21). In this aspect of the present invention, the slit (63) to be formed at a part eccentric from the center of the eccentric rotation body (21). This allows the axial-direction pressing force obtained according to the shape of the slit (63) is centered at a part of the end plate (26A) eccentric from the center of the eccentric rotation body (21). Accordingly, separation of the point of action of the axial-direction pressing force (P) from the point of action of the thrust load (PT) in the axial direction is restrained.

A ninth aspect of the present invention, is the rotary compressor of the first aspect of the present invention, wherein a groove (65) and a through hole (64) are formed, the groove (65) being formed in a portion eccentric away from the center of the eccentric rotation body (21) on a face opposite a face on the cylinder chamber (C1, C2) side of the end plate (26A) of the eccentric rotation body (21) and the through hole (64) being formed in the end plate (26A) for allowing the groove (65) to communicate with the cylinder chamber (C) (C1, C2), and the pressing mechanism (60) introduces part of fluid compressed in the cylinder chamber (C1, C2) into the groove (65) through the through hole (64) to allow the pressure of the fluid to work on the groove (65).

In the ninth aspect of the present invention, part of the fluid compressed in the compression mechanism (20) is introduced into the groove (65) through the through hole (64), so that the axial-direction pressing force readily works in the vicinity of the groove (65) in the end plate (26A) of the eccentric rotation body (21). In this invention, the groove (65) is formed in a part eccentric from the center of eccentric rotation body (21). This allows the axial-direction pressing force obtained according to the shape of the grove (65) to be centered at a part of the end plate (26A) eccentric from the center of the eccentric rotation body (21). Accordingly, separation of the point of action of the axial-direction pressing force (P) from the point of action of the thrust load (PT) in the axial direction is restrained.

A tenth aspect of the present invention, is the rotary compressor of the first aspect of the present invention further including a sealing mechanism (71, 72, 73) for preventing leakage of fluid in at least one of a first axial direction gap between an end face in the axial direction of the cylinder (21) and the piston side end plate (26B) and a second axial direction gap between an end face in the axial direction of the piston (22) and the cylinder side end plate (26A).

In the tenth aspect of the present invention, the sealing mechanism for minimizing the axial-direction gaps between the cylinder (21) and the piston (22) is provided in addition to the aforementioned pressing mechanism (60), so that the fluid at high pressure in, for example, the first chambers (C1-Hp, C2-Hp) is prevented from leaking into the second chambers (C1-Lp, C2-Lp) through the axial-direction gaps in the eccentric rotation of the eccentric rotation body (21, 22).

An eleventh aspect of the present invention, is the rotary compressor of the tenth aspect of the present invention, the sealing mechanism is a chip seal (71, 72, 73) provided at least one of the first axial direction gap and the second axial direction gap.

In the tenth aspect of the present invention, the chip seal (71, 72, 73) is provided at least one of the first axial-direction gap and the second axial-direction gap between the cylinder (21) and the piston (22), minimizing the axial-direction gaps to prevent the fluid in the gaps form leaking.

EFFECTS OF THE INVENTION

According to the first aspect of the present invention, in the compression mechanism (20) including the cylinder (21) having the cylinder chamber (C1) (C1, C2) and the piston (22), the pressing mechanism (60) minimizes the axial-direction gaps between the piston (22) and the cylinder (21), and the eccentric rotation body (21, 22) eccentrically rotates to allow the axial-direction pressing force (P) to work against the thrust load (PT) caused in the cylinder chamber (C) (C1, C2). Working of the axial-direction pressing force (P) on the end plate (26A, 26B) with the center thereof being eccentric from the center of the eccentric rotation body (21, 22) minimizes separation of the axial-direction pressing force (P) from the thrust load (PT) in the radial direction, thereby restraining the turnover moment effectively.

According to the second aspect of the present invention, in the compression mechanism (20) including the cylinder (21) having the circular cylinder chamber (C1) and the circular piston (22), the pressing mechanism (60) minimizes the axial-direction gaps between the piston (22) and the cylinder (21), and the eccentric rotation body (21, 22) eccentrically rotates to allow the axial-direction pressing force (P) to work against the thrust load (PT) caused in the cylinder chamber (C1). Working of the axial-direction pressing force (P) on the end plate (26A, 26B) with the center thereof being eccentric from the center of the eccentric rotation body (21, 22) minimizes separation of the axial-direction pressing force (P) from the thrust load (PT) in the radial direction, thereby restraining the turnover moment effectively.

According to the third aspect of the present invention, in the compression mechanism (20) including the cylinder (21) having the annular cylinder chamber (C1, C2) and the annular piston (22), the pressing mechanism (60) minimizes the axial-direction gaps between the piston (22) and the cylinder (21), and the eccentric rotation body (21, 22) eccentrically rotates to allow the axial-direction pressing force (P) to work against the thrust load (PT) caused in the cylinder chamber (C1, C2). Working of the axial-direction pressing force (P) on the end plate (26A, 26B) with the center thereof being eccentric from the center of the eccentric rotation body (21, 22) minimizes separation of the axial-direction pressing force (P) from the thrust load (PT) in the radial direction, thereby restraining the turnover moment effectively.

According to the fourth aspect of the present invention, in the rotary compressor of the third aspect of the present invention, the blade (23) moves back and forth with the face thereof being in face contact with the blade groove (28) in the swing bush (27) while the swing bush (27) rocks at the divided part of the piston (22), enabling the eccentric rotation body (21, 22) to be in smooth eccentric rotation with the cylinder chamber (C1, C2) divided. Hence, seizing and abrasion at the contact part between the blade (23) and the swing bush (27) can be prevented and gas is prevented from leaking between the first chamber (C1-Hp, C2-Hp) and the second chamber (C2-Lp, C2-Lp).

In the fifth aspect of the present invention, the axial-direction pressing force (P) against the end plate (26A, 26B) obtained from the pressing mechanism (60) is allowed to work on a part near the discharge ports (45, 46), which is liable to receive the thrust load (PT) in the cylinder chamber (C1, C2). Accordingly, the point of action of the axial-direction pressing force (P) can be brought close to the point of action of the thrust load (PT), reducing the turnover moment further effectively.

According to the sixth aspect of the present invention, the pressing mechanism (60) is so composed that the pressure of the fluid at high pressure is allowed to work on the first opposing section (61) into which the end plate (26A, 26B) is defined by the sealing ring (69). The pressing mechanism (60) is easily composed by arranging the sealing ring (69) eccentrically from the center of the eccentric rotation body (21, 22), attaining effective reduction in turnover moment. Thus, the effect of reducing the turnover moment can be obtained with the simple construction.

Further, the sealing ring (29) prevents the refrigerant in the cylinder chamber (C) (C1, C2) from leaking outside the compression mechanism (20) from the first opposing section (61) between the support plate (17) and the end plate (26A, 26B).

According to the seventh aspect of the present invention, the annular groove (17*b*) is formed in the piston (22) or the support plate (17), so that the sealing ring (29) can be held securely at a predetermined position.

According to the eighth aspect of the present invention, the pressing mechanism (60) is so composed that the pressure of the fluid at high pressure is allowed to work on the slit (63) formed in the end plate (26A). The pressing mechanism (60) is easily composed by forming the slit (63) eccentrically from the center of the eccentric rotation body (21), attaining effective reduction in turnover moment. Thus, the effect of reducing the turnover moment can be obtained with the simple construction.

Further, the slit (63) is formed easily by forming a step in the end plate (26A), which means that the end plate (26A) in which the slit (63) is formed can be integrally formed with the eccentric rotation body (21) by, for example, sintering or forging.

According to the ninth aspect of the present invention, the pressing mechanism (60) is so composed that part of the fluid compressed in the cylinder chamber (C1, C2) is allowed to work on the groove (65) through the through hole (64). The pressing mechanism (60) can be easily composed by forming the groove (65) eccentrically from the center of the eccentric rotation body (21), attaining effective reduction in turnover moment.

Further, according to this ninth aspect of the present invention, as the pressure in the cylinder chamber (C1, C2) rises and the thrust load (PT) becomes large, the axial-direction pressing force (P) working on the groove (65) increases. In contrast, when the thrust load (PT) becomes small, the axial-direction pressing force (P) decreases. Hence, an increase in mechanical loss of the eccentric rotation body (21), which is caused due to surplus axial-direction pressing force (P), is prevented, implementing effective reduction in turnover moment.

According to the tenth aspect of the present invention and the eleventh aspect of the present invention, the sealing mechanism (71, 72, 73) is provided in addition to the pressing mechanism (60), so that the fluid is prevented from leaking in the axial-direction gaps between the cylinder (21) and the piston (22), further increasing the compression efficiency.

DETAILED DESCRIPTION OF THE INVENTION

Embodiments of the present invention will be described below with reference to the drawings.

Embodiment 1 of the Invention

A compressor according to Embodiment 1 is a rotary compressor for compressing fluid by expanding and contracting volume in a cylinder chamber described later by eccentrically rotating an eccentric rotation body. This rotary compressor is connected to, for example, a refrigeration circuit for an air conditioner and is used for compressing the refrigerant sucked from an evaporator and discharging it to a condenser.

Figure 1:
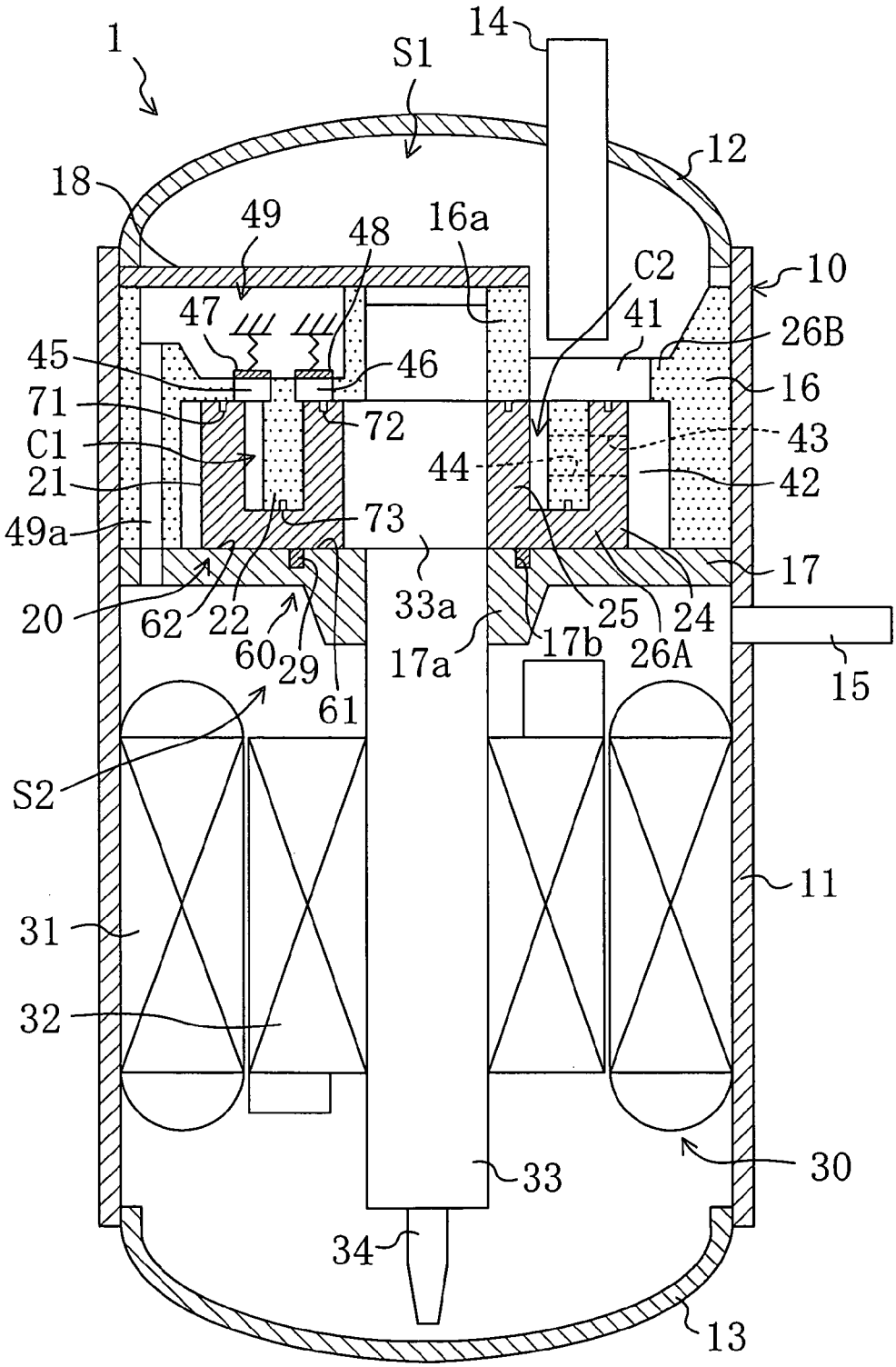
FIG. 1 is a vertical section of a rotary compressor according to Embodiment 1.

As shown in FIG. 1, the rotary compressor (1) is so composed hermetically as a whole that a compression mechanism (20) and an electric motor (a drive mechanism) (30) are accommodated in a casing (10).

The casing (10) is composed of a cylindrical body portion (11), an upper head (12) fixed to the upper end of the body portion (11), and a lower head (13) fixed to the lower end of the body portion (11). An intake pipe (14) passing through the upper head (12) is provided in the upper head (12). A discharge pipe (15) passing through the body portion (11) is provided in the body portion (11).

The compression mechanism (20) is provided in the upper part of the casing (10). The compression mechanism (20) is arranged between an upper housing (16) and a lower housing (a support plate) (17) which are fixed to the casing (10). The compression mechanism (20) includes a cylinder (21) having a cylinder chamber (C1, C2) having annular shapes in section at a right angle in the axial direction, an annular piston (piston) (22) arranged in the cylinder chamber (C1, C2), and a blade (23) which defines the cylinder chamber (C1, C2) into high pressure chambers (compression chambers) (C1-Hp, C2-Hp) serving as first chambers and low pressure chambers (intake chambers) (C1-Lp, C2-Lp) serving as second chambers (see FIG. 2). Further, a cylinder side end plate (26A) is formed at the lower end of the cylinder (21) so as to face the cylinder chamber (C1, C2). Wherein, the cylinder (21) rotates eccentrically as an eccentric rotation body in the present embodiment.

In the lower part of the casing (10), the electric motor (30) is provided which includes a stator (31) and a rotor (32). The stator (31) is fixed to the inner wall of the body portion (11) of the casing (10). The rotor (32) is connected to a drive shaft (33) so as to rotate the drive shaft (33) in association with the rotation of the rotor (32).

The drive shaft (33) extends in the vertical direction to the vicinity of the upper head (12) from the vicinity of the lower head (13). An oil supply pump (34) is provided at the lower end of the drive shaft (33). The oil supply pump (34) is connected to an oil supply passage (not shown in the drawing), which extends upward within the drive shaft (33) and communicates with the compression mechanism (20). The oil supply pump (34) supplies lubricant oil reserved in the bottom of the casing (10) to a sliding section of the compressor (20) through the oil supply passage.

An eccentric portion (33*a*) is formed at a part of the drive shaft (33) located inside the cylinder chamber (C1, C2). The eccentric portion (33*a*) has a diameter larger than the upper part and the lower part of the drive shaft (33) and is eccentric from the axial center of the drive shaft (33) by a predetermined distance.

The cylinder (21) includes an outer cylinder (24) and an inner cylinder (25). The outer cylinder (24) and the inner cylinder (25) are connected at the lower ends thereof with each other to be integral by means of the cylinder side end plate (26A). The inner cylinder (25) is slidably fitted at the eccentric portion (33*a*) of the drive shaft (33).

The annular piston (22) is formed integrally with the upper housing (16) and includes a piston side end plate (26B). Bearing portions (16*a*, 17*a*) for supporting the drive shaft (23) are formed at the upper housing (16) and the lower housing (17), respectively. Thus, the compressor (1) of the present embodiment has a construction in which the drive shaft (33) passes in the vertical direction through the cylinder chamber (C1, C2) and the eccentric portion (33*a*) is held at both ends in the axial direction thereof to the casing (10) by means of the bearing portions (16*a*, 17*a*).

In the compression mechanism (20), the cylinder side end plate (26A) is arranged at one end in the axial direction (the lower end) of the cylinder chamber (C1, C2) so as to face the lower end face in the axial direction of the piston (22) while the piston side end plate (26B) is arranged at the other end in the axial direction (the upper end) of the cylinder chamber (C1, C2) so as to face the upper end face in the axial direction of the cylinder (21).

Figure 2:
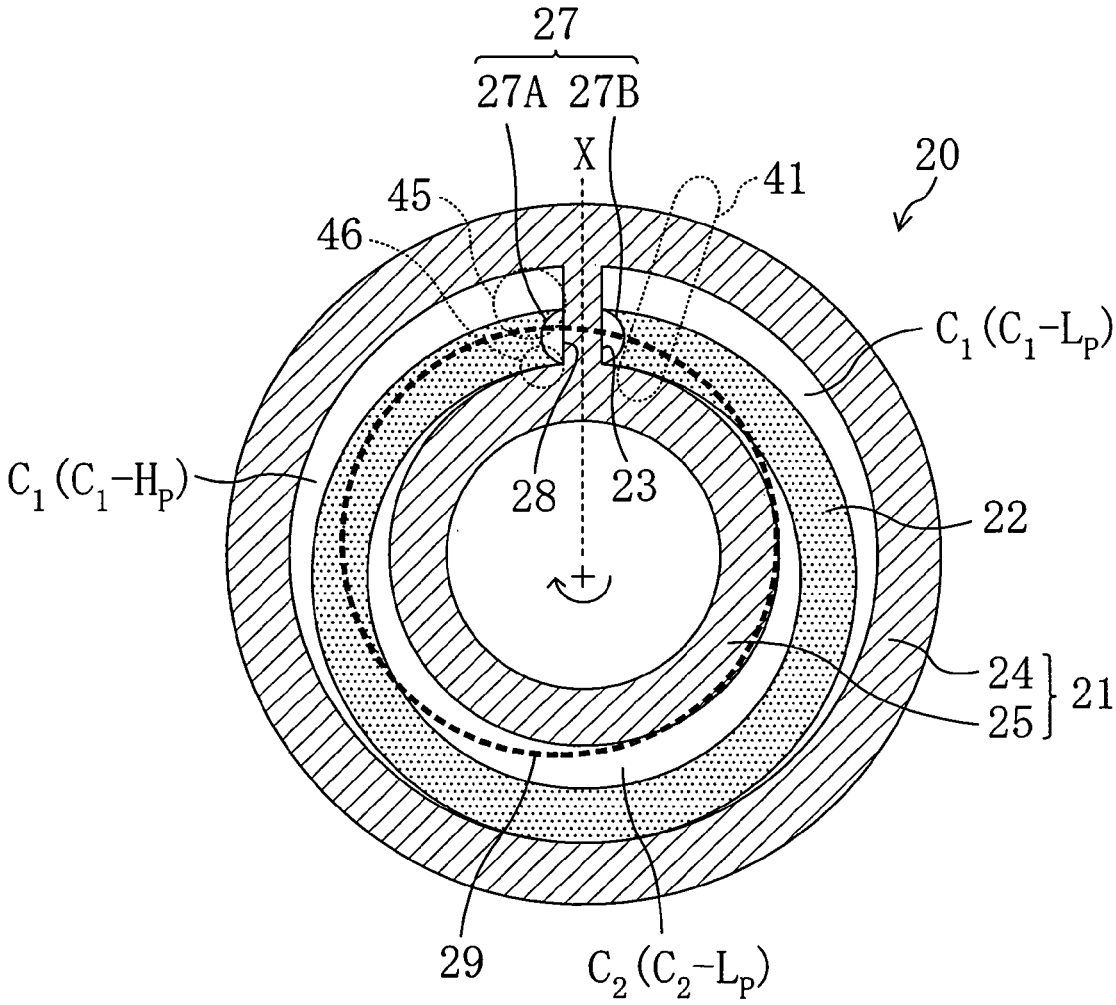
FIG. 2 is a transverse section of a compression mechanism.

As shown in FIG. 2, the compression mechanism (20) includes a swing bush (27) for movably connecting the annular piston (22) and the blade (23) with each other. The annular piston (22) is formed in a C-shape into which a part of an annular shape is divided. The blade (23) extends on the line in the radial direction of the cylinder chamber (C1, C2) from the wall face on the inner peripheral side of the cylinder chamber (C1, C2) (the outer peripheral face of the inner cylinder (25)) to the wall face on the outer peripheral side thereof (the inner peripheral face of the outer cylinder (24)) so as to pass through the divided part of the annular piston (22), and is fixed to the outer cylinder (24) and the inner cylinder (25). The swing bush (27) connects the piston (22) and the blade (23) with each other at the divided part of the annular piston (22). It is noted that the blade (23) may be formed integrally with the outer cylinder (24) and the inner cylinder (25) or may be formed by integrating a separate member with both the cylinders (24, 25).

The inner peripheral face of the outer cylinder (24) and the outer peripheral face of the inner cylinder (25) are cylindrical faces arranged coaxially, and the cylinder chamber (C1, C2) is formed therebetween. The annular piston (22) has an outer peripheral face of which diameter is smaller than that of the inner peripheral face of the outer cylinder (24) and an inner peripheral face of which diameter is larger than that of the outer peripheral face of the inner cylinder (25). Whereby, an outer cylinder chamber (C1) is formed between the outer peripheral face of the annular piston (22) and the inner peripheral face of the outer cylinder (24) while the inner cylinder chamber (C2) is formed between the inner peripheral face of the annular piston (22) and the outer peripheral face of the inner cylinder (25).

Further, in the state that the outer peripheral face of the annular piston (22) is substantially in contact at one point thereof with the inner peripheral face of the outer cylinder (24) (strictly, in the state that though there is a gap on the order of microns therebetween, leakage of refrigerant in the gap is ignorable), the inner peripheral face of the annular piston (22) is substantially in contact at one point 180° different in phase from the contact point with the outer peripheral face of the inner cylinder (25).

The swing bush (27) is composed of a discharge side bush (27A) located on the high pressure chamber (C1-Hp, C2-Hp) side with respect to the blade (23) and an intake side bush (27B) located on the low pressure chamber (C1-Lp, C2-Lp) side with respect to the blade (23). The discharge side bush (27A) and the intake side bush (27B) have the same shape of substantially a semicircle in section and are arranged so as to face each other at the flat faces thereof. The space between the opposing faces of the bushes (27A, 27B) serves as a blade groove (28).

The blade (23) is inserted in the blade groove (28) so as to substantially be in face contact with the flat faces of the swing bushes (27A, 27B) while the circular outer peripheral faces of the swing bushes (27A, 27B) are substantially in face contact with the annular piston (22). The swing bushes (27A, 27B) allows the blade (23) to move back and forth in the direction along the face thereof in the blade groove (28) with the blade (23) inserted in the blade groove (28). Also, the swing bushes (27A, 27B) are capable of rocking integrally with the blade (23) relative to the annular piston (22). Accordingly, the swing bush (27) is so composed that the blade (23) and the annular piston (22) are capable of rocking relatively with the center point of the swing bush (27) as a rocking center and the blade (23) is capable of moving back and forth in the direction along the face of the blade (23) with respect to the annular piston (22).

It is noted that the bushes (27A, 27B) are separated in the present embodiment but may be integral by connecting parts thereof with each other.

In the above described construction, when the drive shaft (33) rotates, the outer cylinder (24) and the inner cylinder (25) rock with the center point of the swing bush (27) as a rocking center while the blade (23) moves back and forth in the blade groove (28). This rocking motion makes the cylinder (21) to rotate (revolve) eccentrically with respect to the drive shaft (33) (see FIG. 3(A) to FIG. 3(D)).

As shown in FIG. 1, an intake port (41) is formed in the upper housing (16) under the intake pipe (14). The intake port (41) ranges wide from the inner cylinder chamber (C2) to an intake space (42) formed outside the outer cylinder (24). The intake port (41) passes through the upper housing (16) in the axial direction thereof to allow the low pressure chambers (C1-Lp, C2-Lp) of the cylinder chamber (C1, C2) and the intake space (42) to communicate with an upper space (a low pressure space (S1)) above the upper housing (16). In the outer cylinder (24), a through hole (43) is formed for allowing the intake space (42) to communicate with the low pressure chamber (C1-Lp) of the outer cylinder chamber (C1). Also, a through hole (44) for allowing the low pressure chamber (C1-Lp) of the outer cylinder (C1) to communicate with the low pressure chamber (C2-Lp) of the inner cylinder chamber (C2) is formed in the annular piston (22).

Discharge ports (45, 46) are formed in the upper housing (16). The discharge ports (45, 46) pass through the upper housing (16) in the axial direction thereof. The lower end of the discharge port (45) opens to the high pressure chamber (C1-Hp) of the outer cylinder chamber (C1) while the lower end of the discharge port (46) opens to the high pressure chamber (C2-Hp) of the inner cylinder chamber (C2). On the other hand, the upper ends of the discharge ports (45, 46) communicate with a discharge space (49) through discharge valves (reed valves) (47, 48) for opening/closing the discharge ports (45, 46), respectively.

The discharge space (49) is formed between the upper housing (16) and a cover plate (18). A discharge passage (49*a*) for allowing the discharge space (49) and the space (a high pressure space (S2)) below the lower housing (17) to communicate with each other is formed through the upper housing (16) and the lower hosing (17).

As one of the features of the present invention, a pressing mechanism (60) for bringing the cylinder side end plate (26A) and the piston side end plate (26B) close to each other in the axial direction of the drive shaft (33) is provided between the cylinder side end plate (26A) and the lower housing (17). Specifically, the pressing mechanism (60) is composed of a sealing ring (29) provided at an opposing part between the lower housing (17) and the cylinder side end plate (26A). The sealing ring (29) is fitted in an annular groove (17*b*) formed in the lower hosing (17) and defines the opposing part between the cylinder side end plate (26A) and the lower hosing (17) into an opposing section (a first opposing section) (61) on the inner side in the radial direction of the sealing ring (29) and an opposing section (a second opposing section) (62) on the outer side in the radial direction of the sealing ring (29).

The sealing ring (29) is arranged eccentrically to the aforementioned discharge ports (45, 46) away from the center of the cylinder (21) fitted in the eccentric portion (33*a*) of the drive shaft (33) (see FIG. 2). In detail, the center of the sealing ring (29) is eccentric within the range between 270° and 360° where the angle is measured in the direction of rotation (the clockwise direction in the present embodiment) of the eccentric rotation body (the cylinder (21) in the present embodiment) from the direction (the X axis shown in FIG. 2) extending along the blade (23) from the center of the drive shaft (33) as a reference angle (0°).

In the above construction, when refrigerant compressed in the cylinder chamber (C1, C2) of the compression mechanism (20) is discharged to the high pressure space (S2), the pressure of the refrigerant works on the lower face of the cylinder side end plate (26A) composing the first opposing section (61) through a gap between the drive shaft (33) and the bearing portion (17*a*). The first opposing section (61) also receives pressure of the lubricant oil in the casing (10). As a result, upward pressing force in the axial direction works on the cylinder side end plate (26A). Wherein, the sealing ring (29) is arrange eccentrically from the center of the cylinder (21) and the center of the drive shaft (33), so that the axial-direction pressing force works also on a part of the cylinder side end plate (26A) which is eccentric from the center of the cylinder (21). In other words, in the pressing mechanism (60), a part eccentric from the center of the cylinder side end plate (26A) that the cylinder (21) includes is the center of the point of action of the axial-direction pressing force.

Further, the rotary compressor (1) of the present embodiment includes a sealing mechanism for minimizing a gap in the axial direction between the cylinder (21) and the annular piston (22) for the purpose of preventing the fluid from leaking in the gap. Specifically, the sealing mechanism includes an annular first chip seal (71) provided at a part (a first axial-direction gap) between the upper end face (the end face in the axial direction) of the outer cylinder (24) and the lower face of the piston side end plate (26B) and an annular second chip seal (72) provided at a part (a first axial-direction gap) between the upper end face (the end face in axial direction) of the inner cylinder (25) and the lower face of the piston side end plate (26B). The sealing mechanism also includes a third chip seal (73) provided at a part (a second axial-direction gap) between the lower end face (the end face in axial direction) of the annular piston (22) and the upper face of the cylinder side end plate (26A).

—Driving Operation—

Figure 3:
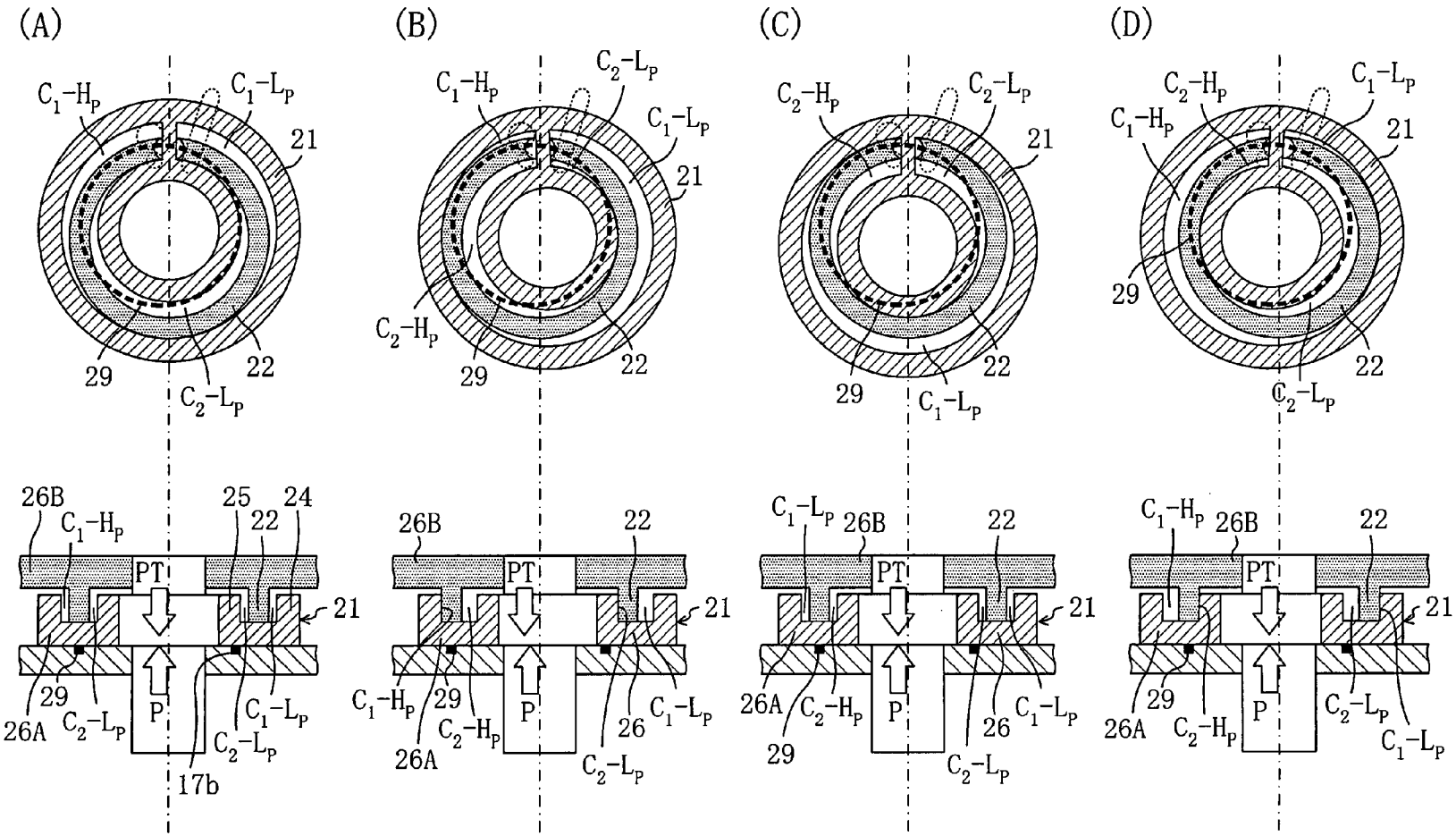
FIG. 3 shows transverse sections illustrating operation of the compression mechanism.

Driving operation of the rotary compressor (1) will be described next with reference to FIG. 3.

When the electric motor (30) starts operating, rotation of the rotor (32) is transmitted to the outer cylinder (24) and the inner cylinder (25) of the compression mechanism (20) through the drive shaft (33). As a result, the blade (23) is in reciprocal motion (moves back and forth) between the swing bushes (27A, 27B) while rocking integrally with the swing bushes (27A, 27B) relative to the annular piston (22). Then, the outer cylinder (24) and the inner cylinder (25) revolve while rocking relative to the annular piston (22) to allow the compression mechanism (20) to perform a predetermined compression process.

Referring to the outer cylinder chamber (C1), the cylinder (21) in the state shown in FIG. 3(D) where the low pressure chamber (C1-Lp) has substantially a minimum volume revolves in the clockwise direction in the drawing to allow the refrigerant to be sucked from the intake port (41) to the low pressure chamber (C1-Lp). Then, the refrigerant is sucked from the intake space (42) communicating with the intake port (41) to the low pressure chamber (C1-Lp) through the through hole (43). When the cylinder (21) revolves to change its state from the state shown in FIG. 3(A) to FIG. 3(B) and to FIG. 3(C) in this order, and then, to the state shown in FIG. 3(D) again, the sucking of the refrigerant to the low pressure chamber (C1-Lp) terminates.

At this point, the low pressure chamber (C1-Lp) becomes the high pressure chamber (C1-Hp) where the refrigerant is compressed while another low pressure chamber (C1-Lp) is formed with intervention of the blade (23). When the cylinder (21) further rotates from this state, the refrigerant sucking is repeated in the newly-formed low pressure chamber (C1-Lp) while the volume of the high pressure chamber (C1-Hp) decreases to compress the refrigerant in the high pressure chamber (C1-Hp). Then, when the pressure of the high pressure chamber (C1-Hp) becomes a predetermined value and the pressure difference from the discharge space (49) reaches a set value, the discharge valve (47) is opened by the refrigerant at high pressure in the high pressure chamber (C1-Hp) to allow the refrigerant at high pressure to flow out into the high pressure space (S2) from the discharge space (49) through the discharge passage (49*a*).

Referring to the inner cylinder chamber (C2), the cylinder (21) in the state shown in FIG. 3(B) where the low pressure chamber (C2-Lp) has substantially a minimum volume revolves in the clockwise direction in the drawing to allow the refrigerant to be sucked from the intake port (41) to the low pressure chamber (C2-Lp). Then, the refrigerant is sucked from the intake space (42) communicating with the intake port (41) to the low pressure chamber (C2-Lp) through the through hole (44). When the cylinder (21) revolves to change its state from the state shown in FIG. 3(C) to FIG. 3(D) and to FIG. 3(A) in this order, and then, to the state shown in FIG. 3(B) again, the sucking of the refrigerant to the low pressure chamber (C2-Lp) terminates.

At this point, the low pressure chamber (C2-Lp) becomes the high pressure chamber (C2-Hp) where the refrigerant is compressed while another low pressure chamber (C2-Lp) is formed with intervention of the blade (23). When the cylinder (21) further rotates from this state, the refrigerant sucking is repeated in the newly-formed low pressure chamber (C2-Lp) while the volume of the high pressure chamber (C21-Hp) decreases to compress the refrigerant in the high pressure chamber (C2-Hp). Then, when the pressure of the high pressure chamber (C2-Hp) becomes a predetermined value and the pressure difference from the discharge space (49) reaches a set value, the discharge valve (48) is opened by the refrigerant at high pressure in the high pressure chamber (C2-Hp) to allow the refrigerant at high pressure to flow out into the high pressure space (S2) from the discharge space (49) through the discharge passage (49*a*).

In this way, the refrigerant at high pressure compressed by the outer cylinder chamber (C1) and the inner cylinder chamber (C2) and flowing in the high pressure space (S2) is discharged from the discharge pipe (15), undergoes the condensation process, the expansion process, and the evaporation process in the refrigeration circuit, and then, is sucked again into the rotary compressor (1).

—Operation of Pressing Mechanism—

Operation of the pressing mechanism (60), which is the significant feature of the present invention, will be described next with reference to FIG. 3.

In the compression process of the above described rotary compressor (1), when the refrigerant becomes at high pressure in the cylinder chamber (C1, C2), the pressure of the refrigerant at high pressure works as a thrust load (PT) on the cylinder side end plate (26A) in the axial direction. If the thrust load (PT) would become large or the point of action of the thrust load (PT) would be away from the drive shaft (33), a turnover moment, which is caused due to the thrust load (PT), may be generated to turn over the cylinder (21) as the eccentric rotation body.

Under the circumstances, in the rotary compressor (1) of the present embodiment, pressing force in the axial direction is generated to work against the thrust load (PT), thereby reducing the turnover moment.

Specifically, when the cylinder (21) is in the state shown in FIG. 3(A), the refrigerant in the high pressure chamber (C1-Hp) of the outer cylinder chamber (C1) becomes at high pressure, and accordingly, the thrust load (PT) works on a part near the high pressure chamber (C1-Hp) away from the center of the cylinder (21). On the other hand, the arrangement of the sealing ring (29) between the cylinder side end plate (26A) and the lower housing (17) as described above allows the pressure of the refrigerant at high pressure to work on the lower face of the cylinder side end plate (26A) in the first opposing section (61) to generate the axial-direction pressing force (P) pushing the cylinder side end plate (26A) upward against the piston (22) in contrast to the thrust load (PT). The sealing ring (29) is arranged eccentrically to the discharge ports (45, 46) away from the center of the cylinder (21), so that the axial-direction pressing force (P) obtained from the pressing mechanism (60) works also on a part near the discharge ports (45, 46) away from the center of the cylinder (21). Hence, the point of action of the axial-direction pressing force (P) readily agrees with the point of action of the thrust load (PT) in the radial direction, reducing the turnover moment effectively.

When the cylinder (21) is in the state shown in FIG. 3(B), the refrigerant in the high pressure chamber (C1-Hp) of the outer cylinder chamber (C1) or the high pressure chamber (C2-Hp) of the inner cylinder chamber (C2) becomes at high pressure to allow the thrust load (PT) to work on a part near the high pressure chamber (C1-Hp) away from the center of the cylinder (21). In this state, also, the axial-direction pressing force (PT) from the pressing mechanism (60) works on a part near the discharge ports (45, 46) away from the center of the cylinder (21), with a result that the point of action of the axial-direction pressing force (P) readily agrees with the point of action of the thrust load (PT) in the radial direction, reducing the turnover moment effectively.

As well, when the cylinder (21) is in the state shown in FIG. 3(D), the refrigerant in the high pressure chamber (C2-Hp) of the inner cylinder chamber (C2) becomes at high pressure to allow the thrust load (PT) to work on a part near the high pressure chamber (C2-Hp) away from the center of the cylinder (21). In this state, also, the axial-direction pressing force (PT) works on a part near the discharge ports (45, 46) away from the center of the cylinder (21), with a result that the point of action of the axial-direction pressing force (P) readily agrees with the point of action of the thrust load (PT) in the radial direction, reducing the turnover moment effectively.

Effects of Embodiment 1

The following effects are exhibited in Embodiment 1.

In the present embodiment, the axial-direction pressing force (P) obtained from the pressing mechanism (60) against the cylinder side end plate (26A) works on a part near the discharge ports (45, 46) away from the center of the cylinder (21) where the thrust load (PT) is liable to work in the cylinder chamber (C1, C2). This brings the point of action of the axial-direction pressing force (P) close to the point of action of the thrust load (PT), reducing the turnover moment effectively.

The pressing mechanism (60) can be easily attained by arranging the sealing ring (29) between the cylinder side end plate (26A) and the lower housing (17). In other words, the aforementioned turnover moment can be reduced effectively with the simple construction.

Further, the pressing mechanism (60) brings the cylinder side end plate (26A) close to the piston side end plate (26B) in the axial direction to minimize the first axial-direction gaps and the second axial-direction gap between the cylinder (21) and the piston (22), preventing the refrigerant from leaking in the axial-direction gaps. Hence, the compression efficiency of the rotary compressor can be increased.

In addition, in Embodiment 1, the plurality of chip seals (71, 72, 73) are provided in the first axial-direction gaps and the second axial-direction gap between the cylinder (21) and the piston (22), respectively, thereby further preventing the fluid from leaking in the axial-direction gaps between the cylinder (21) and the piston (22) to further increase the compression efficiency.

Modified Example 1 of Embodiment 1

Figure 4:
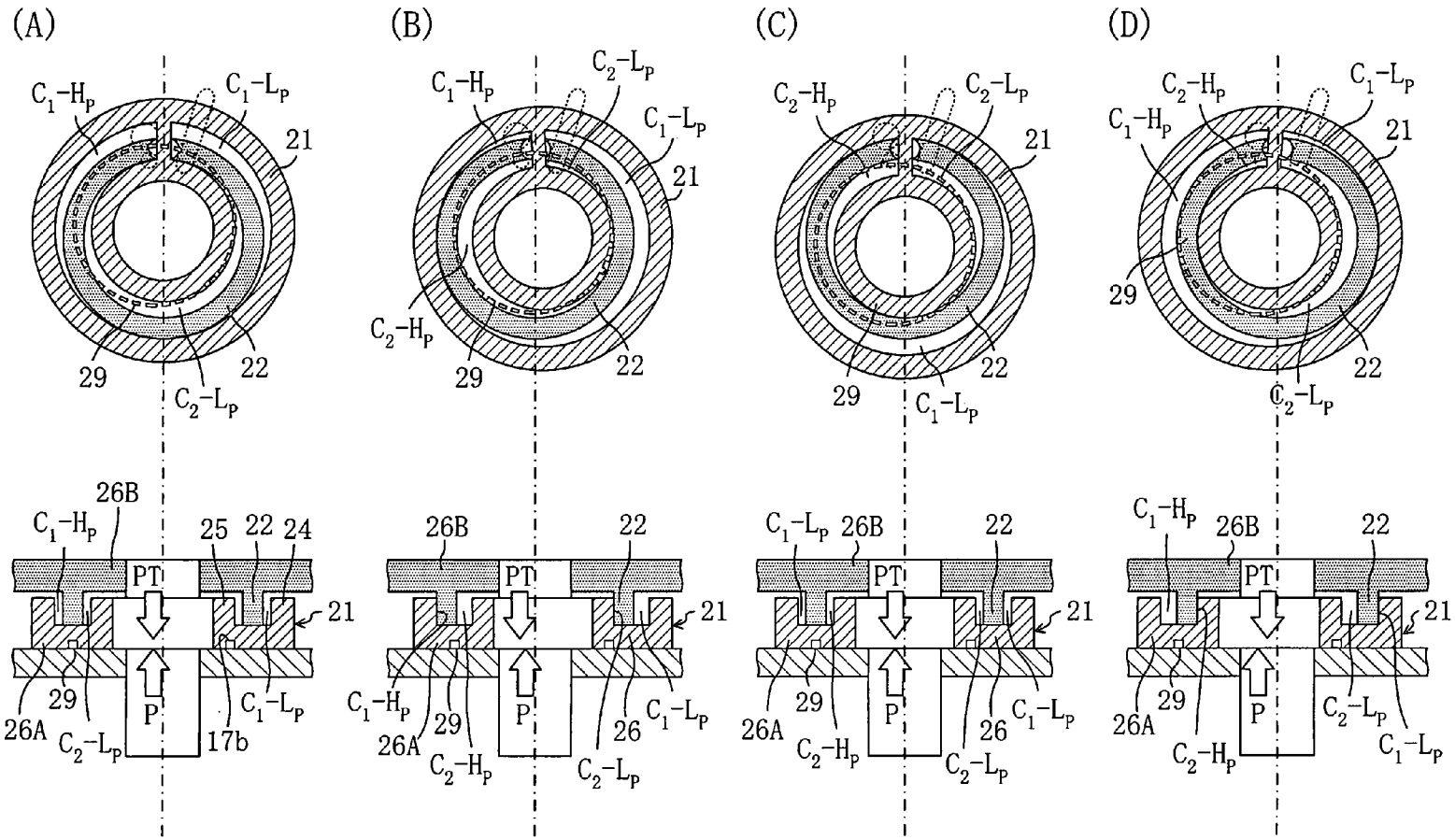
FIG. 4 shows transverse sections illustrating operation of a compression mechanism of a rotary compressor according to Modified Example 1 of Embodiment 1.

Modified Example 1 of Embodiment 1 will be described next. Modified Example 1 is different from Embodiment 1 in the position of the sealing ring (29). Specifically, the sealing ring (29) in this modified example is fitted in an annular groove (17*b*) formed in the lower face portion of the cylinder side end plate (26A), as shown in FIG. 4, in contrast to the sealing ring (29) in Embodiment 1 which is fitted in the annular groove (17*b*) formed in the lower housing (17). Wherein, the sealing ring (29) is arranged eccentrically 20 to the discharge ports (45, 46) away from the center of the cylinder (21), similarly to that in Embodiment 1.

In Modified Example 1, also, the axial-direction pressing force (P) obtained from the pressing mechanism (60) less separates from the thrust load (PT) in the radial direction, as shown in FIG. 4(A) to FIG. 4(D), reducing the turnover moment effectively.

Modified Example 2 of Embodiment 1

Modified Example 2 of Embodiment 1 will be described next. Modified Example 2 is different from Embodiment 1 in the form of the pressing mechanism (60). Specifically, a slit (63) is formed as the pressing mechanism (60) in Modified Example 2.

Figure 5:
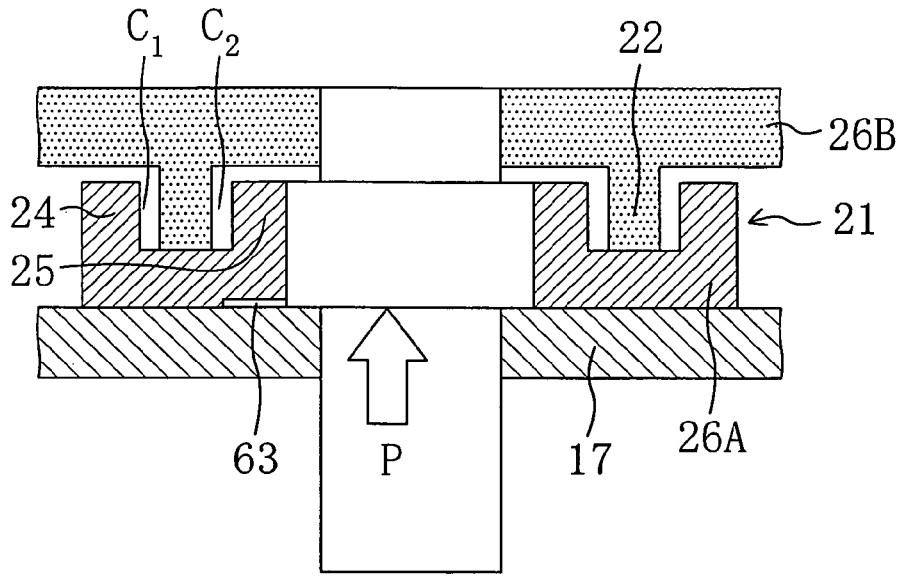
FIG. 5 is a vertical section of a compression mechanism of a rotary compressor according to Modified Example 2 of Embodiment 1.

As shown in FIG. 5, the slit (63) is formed in the lower face portion of the cylinder side end plate (26A) in Modified Example 2. The slit (63) is formed eccentrically to the discharge ports (45, 46) away from the center of the cylinder (21). When the pressure of the refrigerant at high pressure works on the slit (63), pressure gradient is generated to allow the axial-direction pressing force eccentric to the discharge ports (45, 46) (leftward in FIG. 5) away from the center of the cylinder (21) to work on the cylinder side end plate (26A). Thus, the point of action of the axial-direction pressing force (P) in the cylinder side end plate (26A) can be brought close to the point of action of the thrust load (PT), reducing the turnover moment effectively.

Furthermore, the slit (63) can be formed easily by forming a step in the cylinder side end plate (26A). This means that the slit (63) can be easily formed in forming the cylinder (21) and the cylinder side end plate (26A) integrally, for example, by sintering or forging.

Modified Example of Embodiment 1

Modified Example 3 of Embodiment 1 will be described next. Modified Example 3 is different from Embodiment 1 and Modified Example 2 in constitution of the pressing mechanism (60). Specifically, through holes (64) and grooves (65) which are formed in the cylinder side end plate (26A) are utilized as the pressing mechanism (60) in Modified Example 3.

Figure 6:
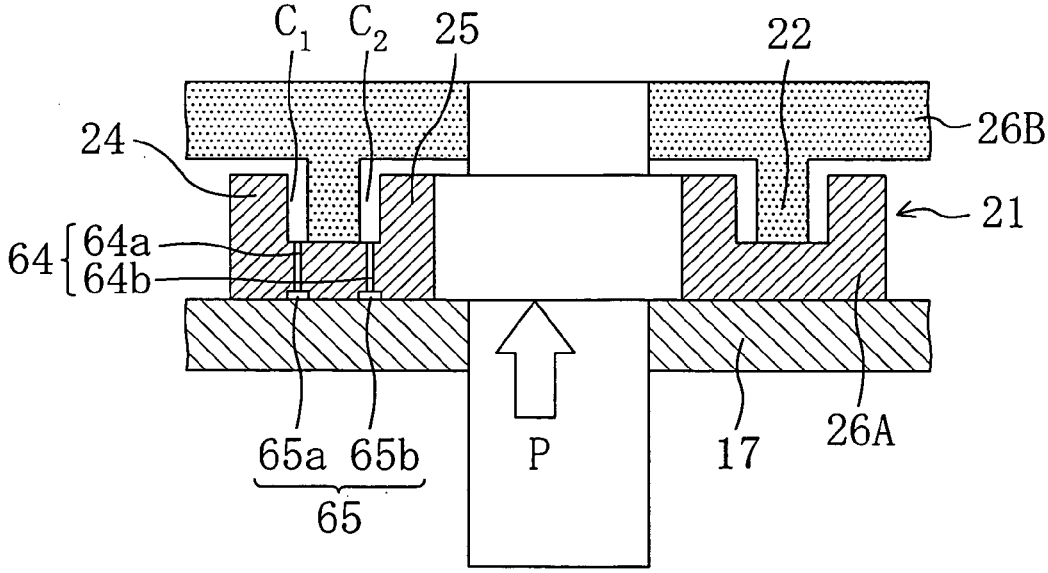
FIG. 6 is a vertical section of a compression mechanism of a rotary compressor according to Modified Example 3 of Embodiment 1.

In Modified Example 3, two through holes (64) and two grooves (65) are formed in the cylinder side end plate (26A), as shown in FIG. 6. Specifically, the through holes (64) are an outer through hole (64*a*) communicating with the outer cylinder chamber (C1) and an inner through hole (64*b*) communicating with the inner cylinder chamber (C2). On the other hand, the grooves (65) are an outer grove (65*a*) communicating with the outer through hole (64*a*) and an inner groove (65*b*) communicating with the inner through hole (65*b*). Each of the grooves (65) and the through holes (64*b*) is formed eccentrically to the discharge ports (45, 46) away from the center of the cylinder (21).

In the above construction, when the refrigerant is compressed in the cylinder chamber (C1, C2), the refrigerant at high pressure flows into the respective grooves (65) through the respective through holes (64). When the refrigerant flows in the respective grooves (65), the pressure of the refrigerant works on the respective grooves (65). In this way, in Modified Embodiment 3, part of the refrigerant compressed in the cylinder chamber (C1, C2) is allowed to flow into the grooves (65) and the pressure of the refrigerant is utilized, thereby obtaining the axial-direction pressing force pushing upward the cylinder side end plate (26A). The thus obtained axial-direction pressing force (P) works on a part near the discharge ports (45, 46) away from the center of the cylinder (21), reducing the turnover moment effectively.

Further, in Modified Example 3, the pressure of the refrigerant compressed in the cylinder chamber (C1, C2) is utilized as the pressing mechanism (60), and accordingly, the axial-direction pressing force (P) working on the grooves (65) increases as the thrust load (PT) is increased in association with an increase in pressure in the cylinder chamber (C1, C2). In contrast, the axial-direction pressing force (P) decreases as the thrust load (PT) is decreased. Thus, the mechanical loss of the eccentric rotation body caused due to surplus axial-direction pressing force (P) is prevented from increasing, implementing effective reduction in turnover moment.

Moreover, in Modified Example 3, the upper openings of the through holes (64) are blocked by the lower end of the piston (22) according to revolution of the cylinder (21), enabling adjustment of the opening of the upper openings. By the adjustment, the opening of the upper openings of the through holes (64) can be made small to reduce excessive pressure, for example, when the pressure in the cylinder chamber (C1, C2) rises to excessively increase the pressure working on the grooves (65). On the contrary, when the pressure working on the grooves (65) becomes insufficient due to a decrease in pressure, for example, in the cylinder chamber (C1, C2), the opening of the upper openings of the through hoes (64) can be made large to increase the pressure. In this way, the pressure in the cylinder chamber (C1, C2), which varies according to the position of the cylinder (21) in revolving motion, is balanced with the opening of the through holes (64), attaining optimum adjustment of the axial-direction pressing force (P) working on the grooves (65).

Embodiment 2 of the Invention

In Embodiment 2 of the present invention, the annular piston (22) rotates eccentrically as the eccentric rotation body in contrast to the Embodiment 1 in which the cylinder (21) rotates eccentrically as the eccentric rotation body.

Figure 7:
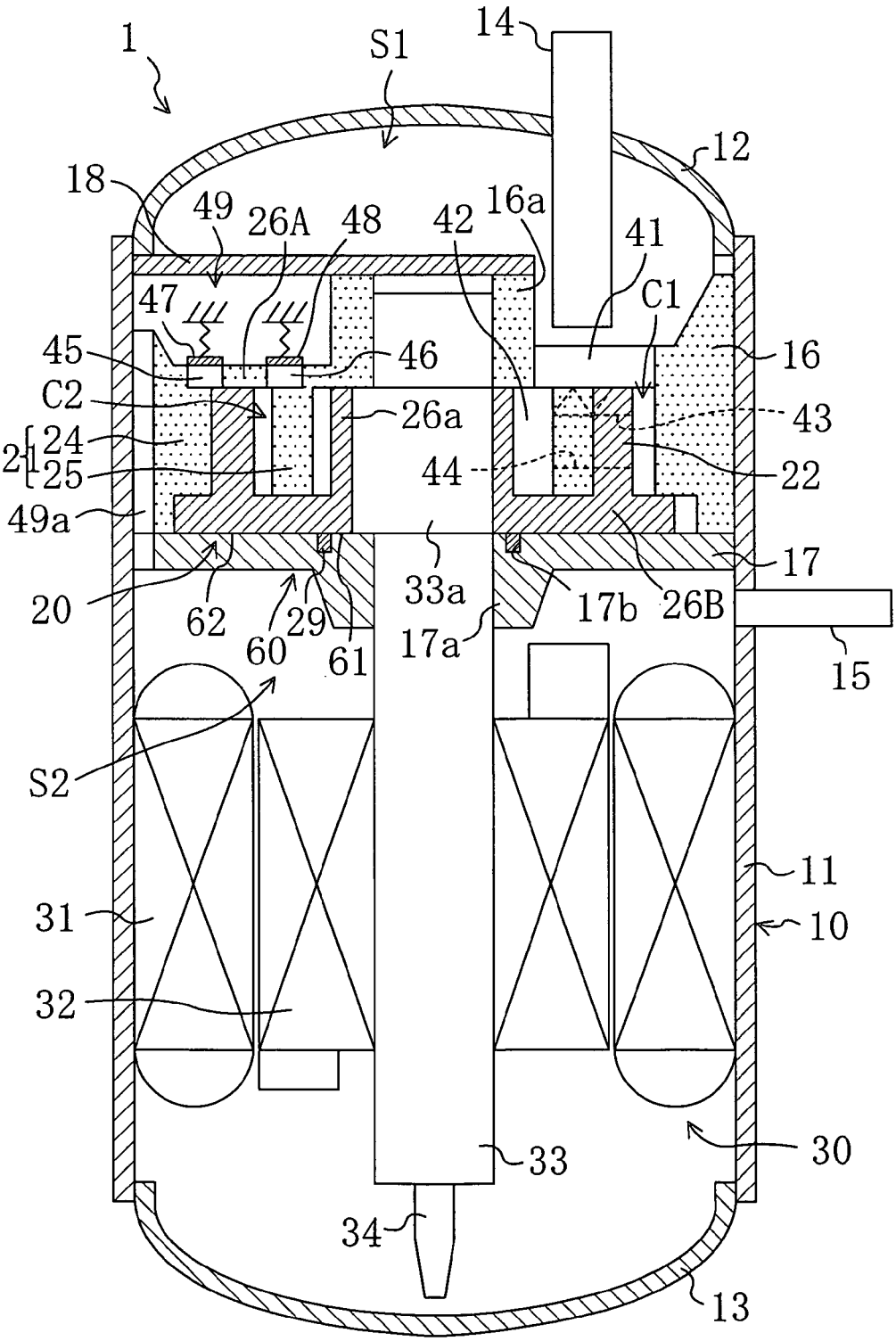
FIG. 7 is a vertical section of a rotary compressor according to Embodiment 2.

In Embodiment 2, as shown in FIG. 7, the compression mechanism (20) is arranged in the upper part of the casing (10), similarly to that in Embodiment 1. The compression mechanism (20) is arranged between the upper housing (16) and the lower housing (17), similarly to that in Embodiment 1.

The outer cylinder (24) and the inner cylinder (25) are provided in the upper housing (16), which is the difference from Embodiment 1. The outer cylinder (24) and the inner cylinder (25) are integrated with the upper housing (16), thereby forming the cylinder (21). The cylinder side end plate (26A) is integrally formed at the upper ends of the outer cylinder (24) and the inner cylinder (25).

The annular piston (22) is held between the upper housing (16) and the lower hosing (17). The piston side end plate (26B) is integrally formed with the lower end of the annular piston (22). A hub (26*a*) is provided at the piston side end plate (26B) so as to be silidably fitted to the eccentric portion (33*a*) of the drive shaft (33). Accordingly, in this construction, when the drive shaft (33) rotates, the annular piston (22) rotates eccentrically in the cylinder chamber (C1, C2). The blade (23) is formed integrally with the cylinder (21), similarly to that in Embodiment 1.

In the upper housing (16), there are formed an intake port (41) allowing the low pressure space (S1) above the compression mechanism (20) in the casing (10) to communicate with the outer cylinder chamber (C1) and the inner cylinder chamber (C2), the discharge port (45) for the outer cylinder chamber (C1), and a discharge port (46) for the inner cylinder chamber (C2). The intake space (42) communicating with the intake port (41) is formed between the hub (26*a*) and the inner cylinder (25) while the through hole (44) and the through hole (43) are formed in the inner cylinder (25) and the annular piston (22), respectively.

The cover plate (18) is provided above the compression mechanism (20) so that the discharge space (49) is formed between the upper housing (16) and the cover plate (18). The discharge space (49) communicates with the high pressure space (S2) below the compression mechanism (20) through the discharge passage (49*a*) formed through the upper housing (16) and the lower housing (17).

In the construction in Embodiment 2, the sealing ring (29) is arranged between the piston side end plate (26B) and the lower hosing (17). The sealing ring (29) is arranged eccentrically to the discharge ports (45, 46) away from the center of the annular piston (22) as the eccentric rotation body. Further, the pressing mechanism (60) is so composed that makes the axial-direction pressing force works on a part eccentric to the discharge ports (45, 46) away from the center of the annular piston (22) in the piston side end plate (26B).

In Embodiment 2, the axial-direction pressing force (P) generated by the pressing mechanism (60) readily agrees with the thrust load (PT), which is generated eccentrically to the discharge ports (45, 46) away from the center of the annular piston (22), when the annular piston (22) is in the revolving motion in the order from FIG. 8(A) to FIG. 8(D), thereby reducing the turnover moment with respect to the annular piston (22) effectively.

Figure 8:
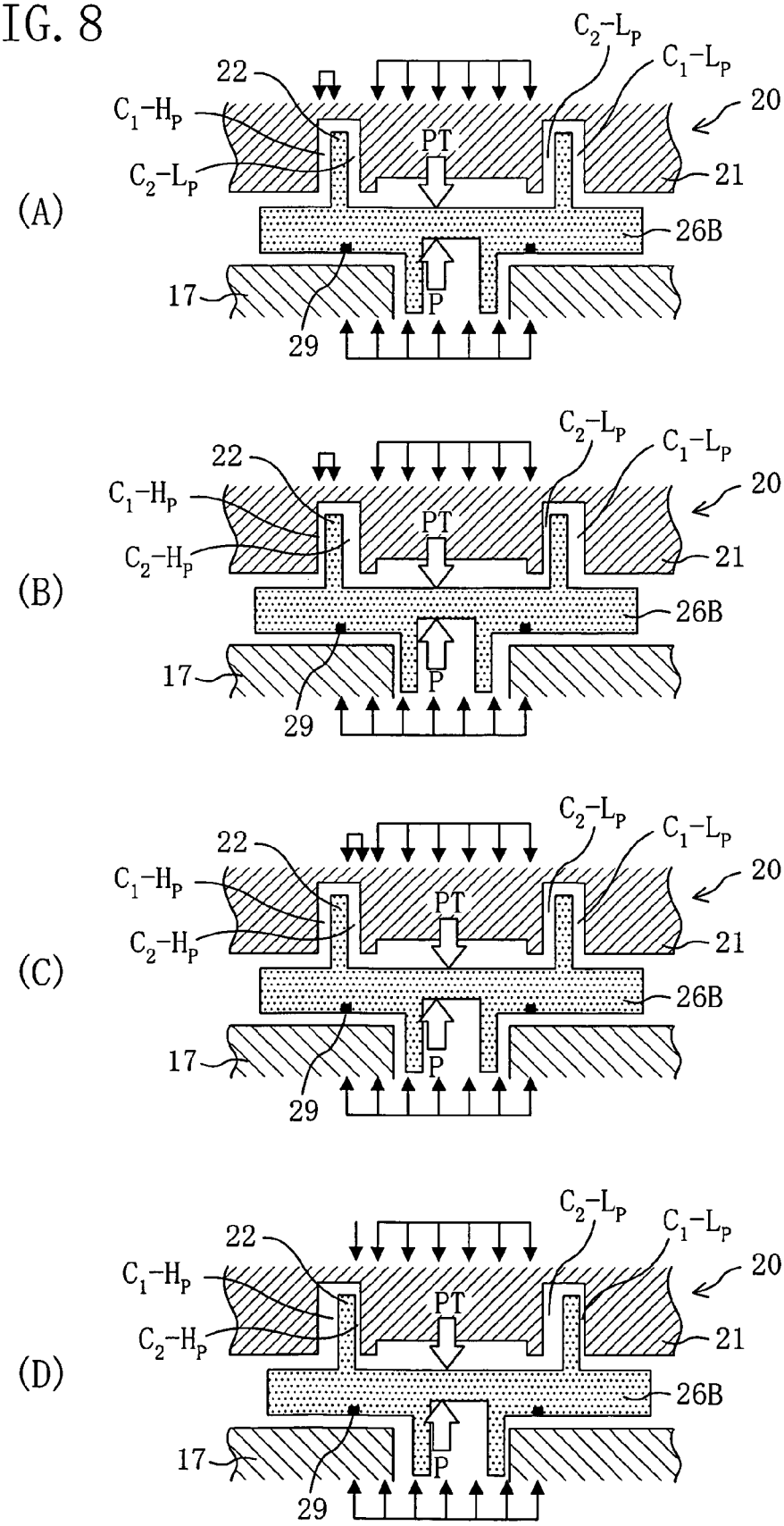
FIG. 8 shows transverse sections illustrating operation of a compression mechanism.

The sealing ring (29) is provided in the lower housing (17) in FIG. 7 while the sealing ring (29) is provided in the piston side end plate (26B) in FIG. 8 as a modified example thereof, wherein the respective pressing mechanisms (60) operate in the same fashion.

Embodiment 3

In Embodiment 3 of the present invention, the low pressure space (S1) and the high pressure space (S2) which are partitioned by the compression mechanism (20) in the casing (10) are arranged in reverse to those in Embodiments 1 and 2.

Figure 9:
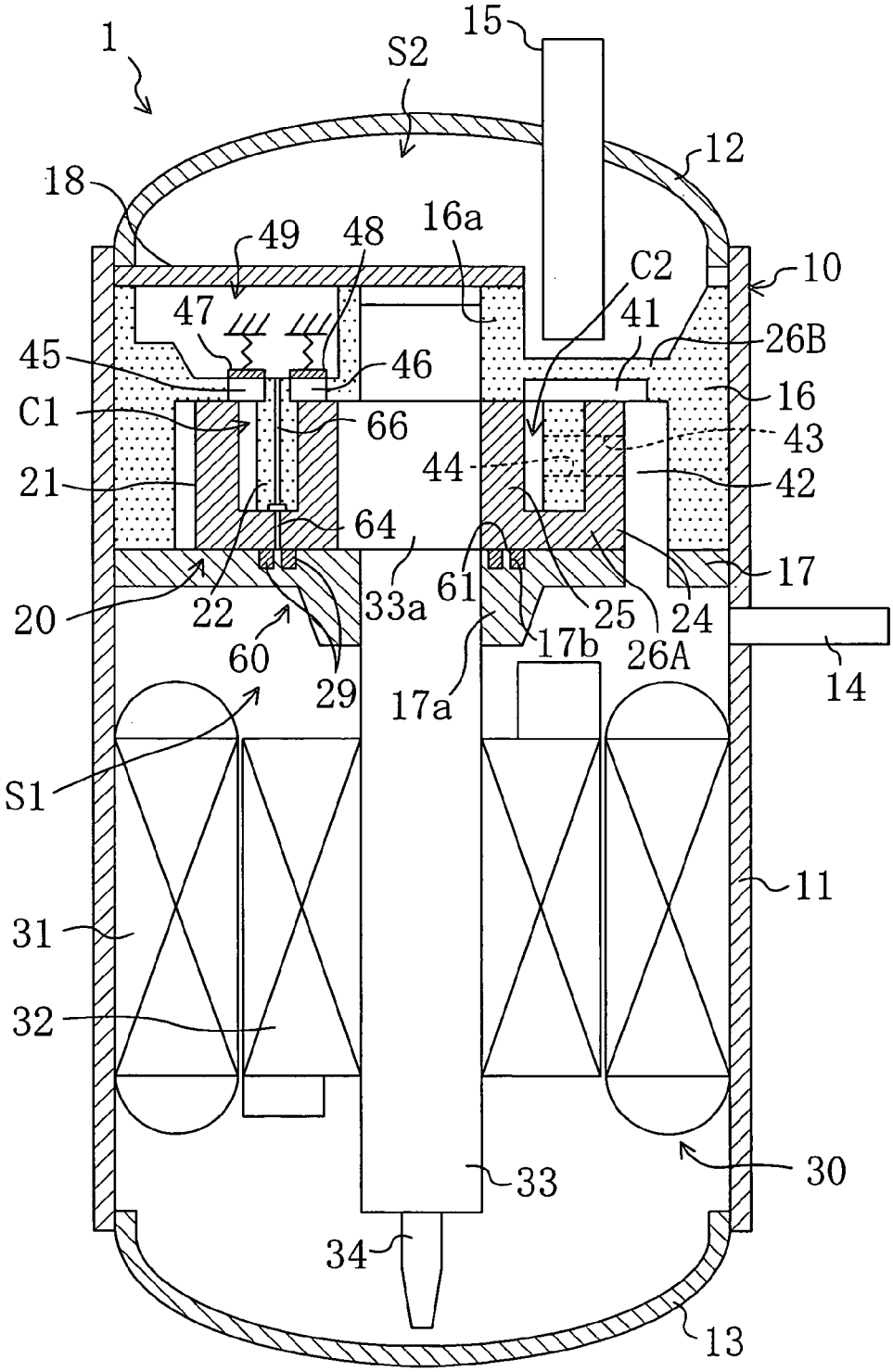
FIG. 9 is a vertical section of a rotary compressor according to Embodiment 3.

Specifically, in Embodiment 3, as shown in FIG. 9, the intake pipe (14) passes through the body portion (11) and the discharge pipe (15) passes through the upper head (12). The intake pipe (14) communicates with the low pressure space (S1) formed below the compression mechanism (20) while the discharge pipe (15) communicates with the high pressure space (S2) formed above the compression mechanism (20).

The low pressure space (S1) communicates with the intake space (42) extending from the lower housing (17) to the upper housing (16). The intake space (42) communicates at the middle part in the axial direction thereof with the cylinder chamber (C1, C2) through the respective through holes (43, 44) in the outer cylinder (24) and the piston (22). Further, the intake space (42) communicates at the upper end thereof with the intake port (41) formed in the upper housing (16). The intake port (41) communicates with the cylinder chamber (C1, C2), similarly to that in Embodiments 1 and 2. On the other hand, the high pressure space (S2) communicates with the discharge space (49) through a discharge passage not shown.

Moreover, in Embodiment 3, a high pressure introducing passage (66) is formed so as to extend from the upper housing (16) to the annular piston (22). The high pressure introducing passage (66) has an upper end opening formed between two discharge valves (47, 48) and a lower end opening at the lower end in the axial direction of the annular piston (22). A through hole (64) is formed in the cylinder (21) so as to communicate with the lower end opening of the high pressure introducing passage (66). The through hole (64) extends in the axial direction up to the opposing part between the cylinder side end plate (26A) and the lower housing (17). Further, two sealing rings (29) are provided beside the through hole (64) in the lower end portion. The two sealing rings (29) define the opposing part between the cylinder side end plate (26A) and the lower housing (17) into three opposing sections. Of the opposing sections, an annular opposing section interposed between the two sealing rings (29) serves as the first opposing section (61) that communicates with the through hole (64).

In the above described construction, the refrigerant at high pressure compressed in the compression mechanism (20) and discharged in the discharge space (49) is introduced into the first opposing section (61) through the high pressure introducing passage (66) and the through hole (64). As a result, the pressure of the refrigerant at high pressure works on the cylinder side end plate (26A) in the first opposing section (61). The sealing rings (29) are arranged eccentrically to the discharge ports (45, 46) away from the center of the cylinder (21), so that the axial-direction pressing force working upward on the cylinder side end plate (26A) works on a part eccentric to the discharge ports (45, 46) away from the center of the cylinder (21). Accordingly, as described above, the turnover moment caused due to the thrust load can be reduced effectively.

Furthermore, the sealing mechanism is so composed that the cylinder (21) is pushed towards the annular piston (22) in the axial direction to minimize the axial-direction gaps between the cylinder (21) and the annular piston (22) by using the sealing rings (29), resulting in prevention of the refrigerant in the cylinder chambers (C1, C2) from leaking.

Modified Example of Embodiment 3

Figure 10:
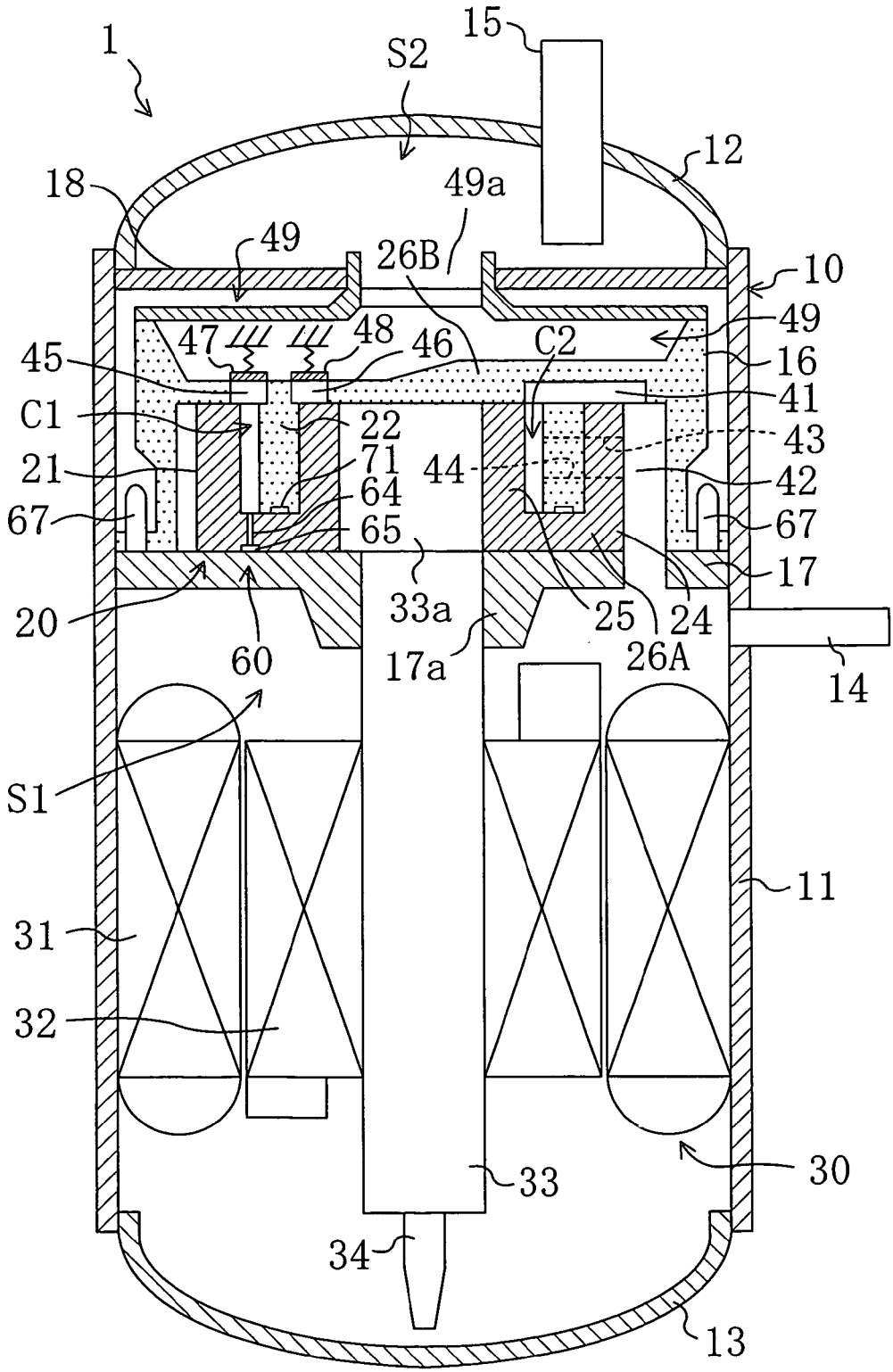
FIG. 10 is a vertical section of a rotary compressor according to Modified Example of Embodiment 3.

A modified example of Embodiment 3 will be described next with reference to FIG. 10. In this modified example, the low pressure space (S1) is formed below the compression mechanism (20) while the high pressure space (S2) is formed above the compression mechanism (10), similarly to the case in Embodiment 3, but the upper housing (16) in this modified example is different from that in Embodiment 3.

In the upper housing (16) of this modified example, the discharge space (49) is formed wider in radial direction than that in Embodiment 3. Further, a discharge passage (49*a*) allowing the high pressure space (S2) and the discharge space (49) to communicate with each other is formed substantially coaxially with the drive shaft (33).

Moreover, the upper housing (16) is not fixed to the inner wall of the body portion (10) and is held by engaging with a plurality of pins (67) provided at the upper face on the outer peripheral side of the lower housing (17). Further, in this modified example, a chip seal (71) is provided between the lower end face of the annular piston (22) and the upper face of the cylinder side end plate (26A).

In the above construction, the sealing mechanism for pushing upwards in the axial direction the upper housing (16) and the annular piston (22) towards the cylinder (21) is so composed that the pressure of the refrigerant at high pressure in the high pressure space (S2) is allowed to work on the wall face of the upper housing (16) facing the discharge space (49). Accordingly, the axial-direction gaps between the cylinder (21) and the annular piston (22) can be minimized.

Moreover, in this modified example, almost similarly to, for example, Modified Example 3 of Embodiment 1, the pressing mechanism (60) is so composed that a through hole (64) and a groove (65) are formed in the cylinder (22) to allow the refrigerant at high pressure in the cylinder chambers (C1, C2) to work on the groove (65). In this case, also, the pressing mechanism (60) reduces the turnover moment in the cylinder (21).

Other Embodiments

The present invention has the following variations on the above embodiments.

In Embodiment 1, the center of the sealing ring (29) provided in the lower housing (17) is located eccentrically to the discharge ports (45, 46) away from the center of the cylinder (21). However, the center of the sealing ring (29) may be located eccentrically to the discharge ports (45, 46) away from the center of the lower housing (17), namely, away from the center of the drive shaft (33). In this case, also, the axial-direction pressing force can be centered at a part near the discharge ports (45, 46) so that the point of action of the axial-direction pressing force (P) can be brought close to the point of action of the thrust load (PT). Hence, the turnover moment can be reduced.

In the above embodiments, the pressing mechanism (60) for allowing the axial-direction pressing force to work on the cylinder side end plate (26A) or the piston side end plate (26B) is applied to the rotary compressor (1) including the two cylinder chambers (C1, C2). However, the pressing mechanism (60) is applicable to other rotary compressors (1).

Figure 11:
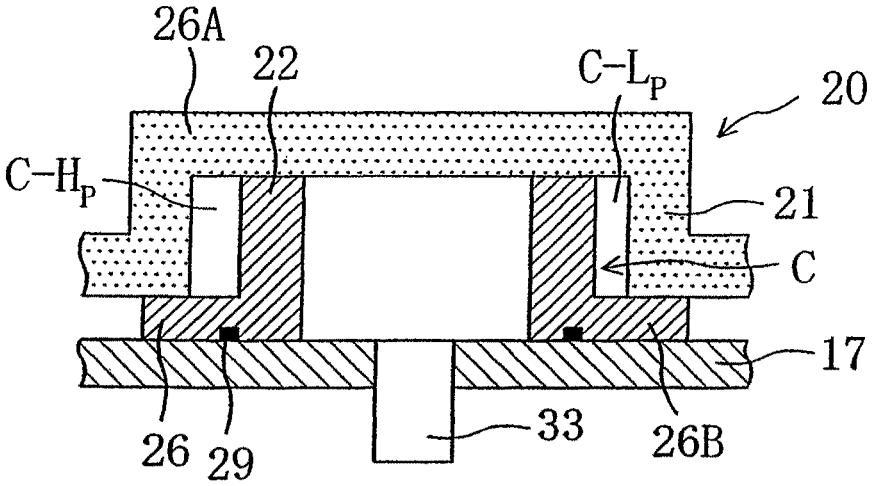
FIG. 11 is a vertical section of a compression mechanism of a rotary compressor according to another embodiment.
Figure 12:
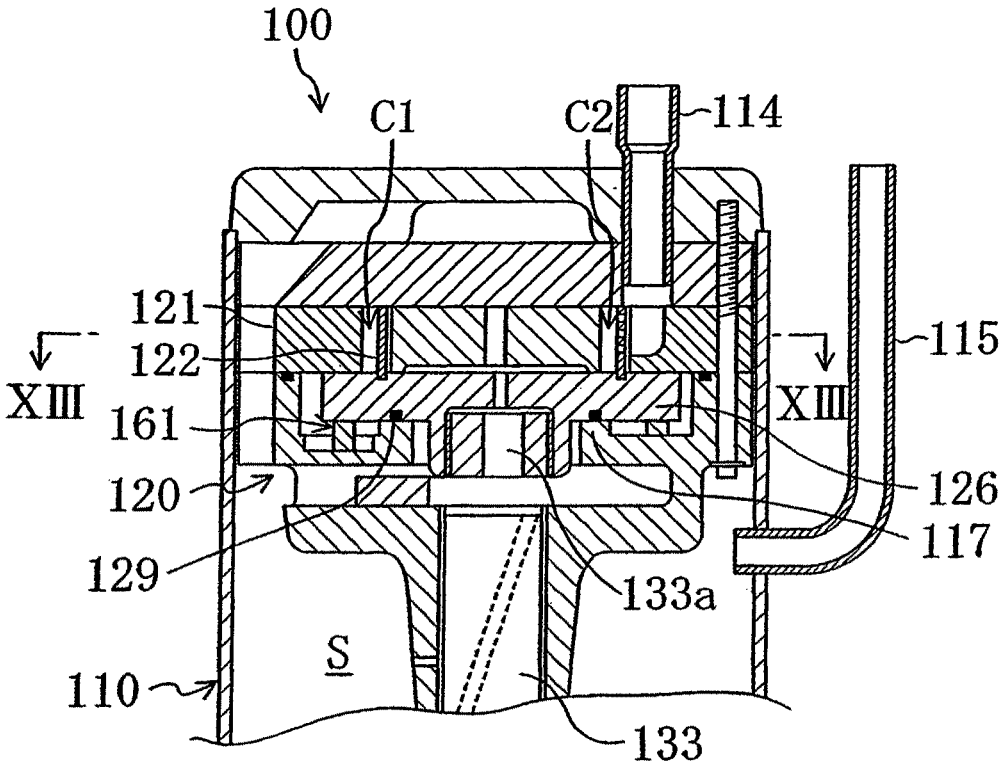
FIG. 12 Prior Art
FIG. 12 is a vertical section in part of a rotary compressor according to a conventional technique.
Figure 13:
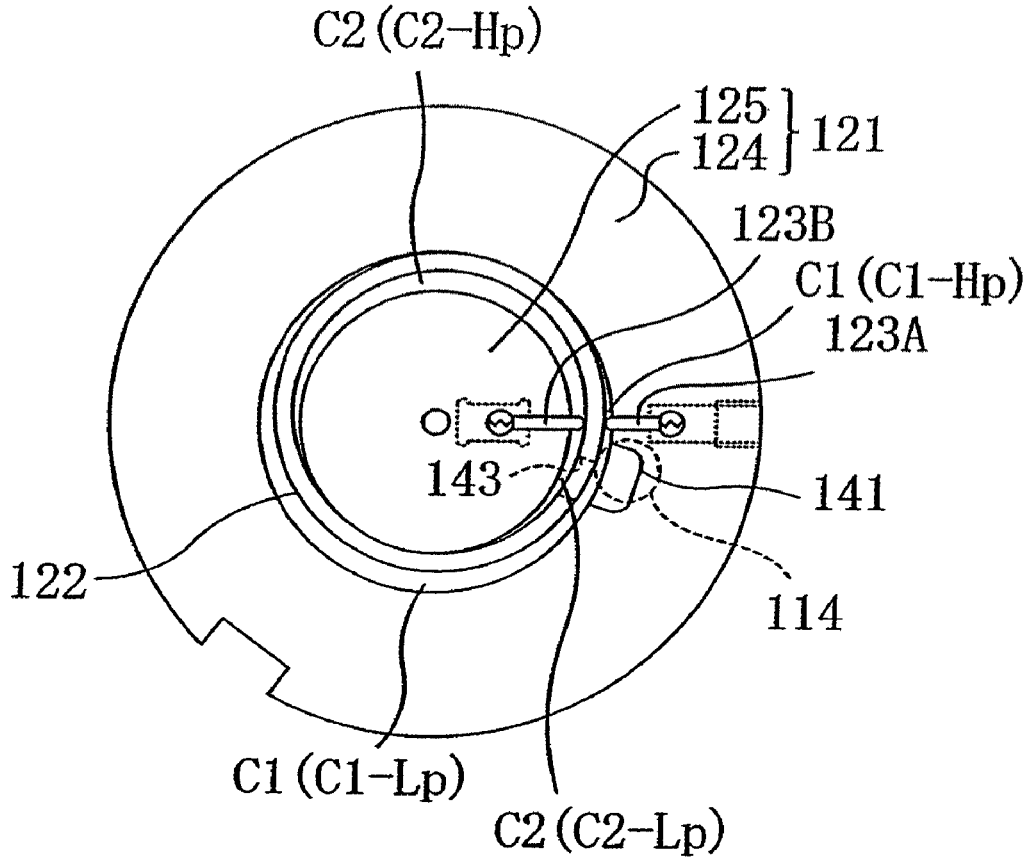
FIG. 13 Prior Art
FIG. 13 is a section taken along the line XIII-XIII in FIG. 12.
Figure 14:
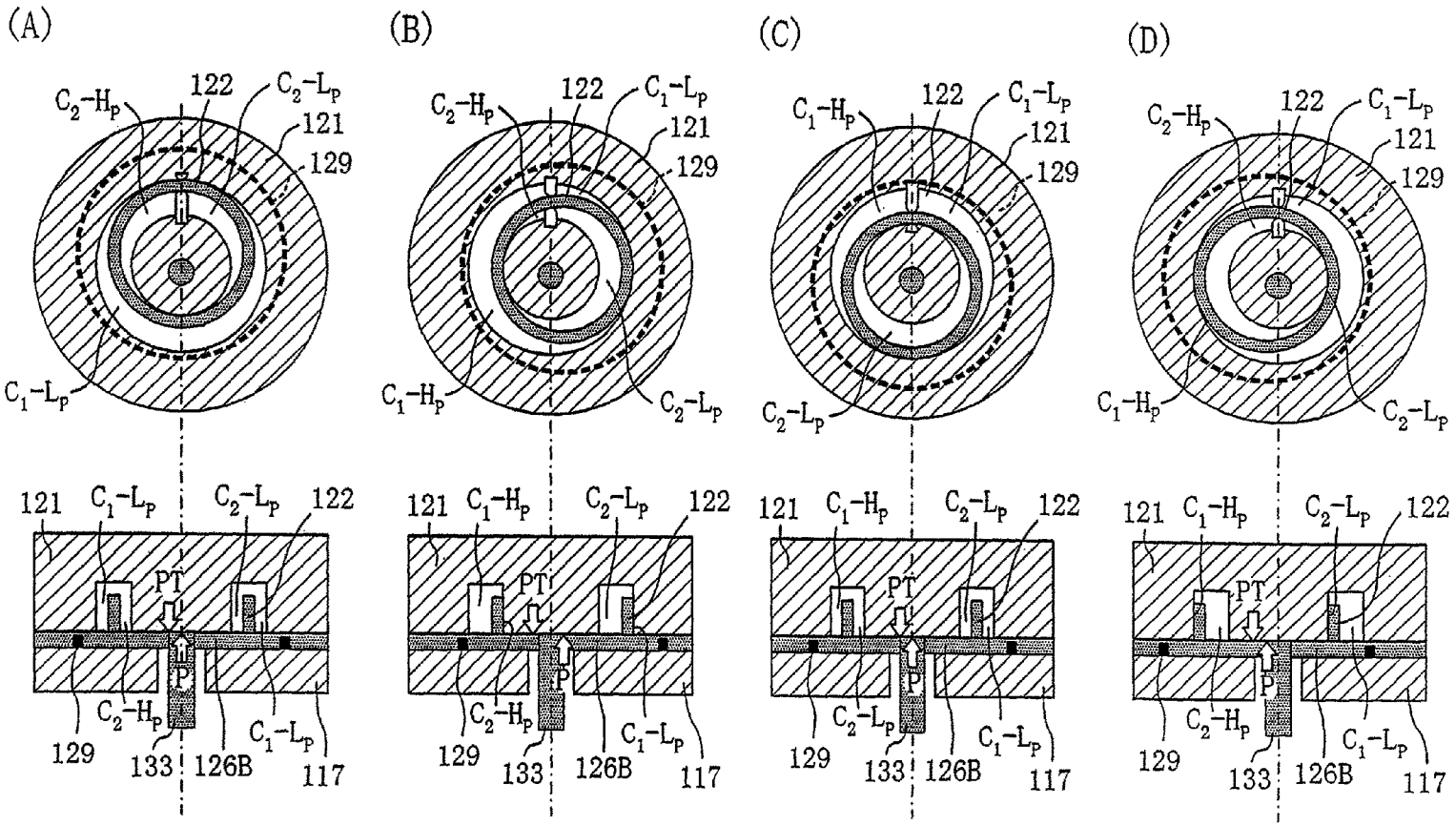
FIG. 14 Prior Art
FIG. 14 shows transverse sections illustrating operation of a compression mechanism.

A rotary compressor (1) shown in FIG. 11, for example, includes a cylinder (21) having a cylinder chamber (C) in a circular shape in section at a right angle in the axial direction and a piston (22) in a circular shape arranged in the cylinder chamber (C). The cylinder chamber (C) is defined by a blade not shown into a first chamber (C-Hp) and a second chamber (C-Lp). Further, the cylinder side end plate (26A) facing the inside of the cylinder chamber (C) is formed at the upper end of the cylinder (21) while the piston side end plate (26B) facing at a part thereof the inside of the cylinder chamber (C) is formed at the lower end of the piston (22).

In the above construction, also, the axial-direction pressing force obtained by providing the sealing ring (29) or the like is made eccentric away from the center of the piston (22) to prevent separation of the point of action of the axial-direction pressing force from the point of action of the thrust load in the radial direction, thereby reducing the turnover moment effectively.

In addition, in the above embodiments, the axial-direction pressing force is obtained from the high pressure in the high pressure space (S2), the pressure (medium pressure) in the cylinder chamber (C1, C2), or the like. While, the axial-direction pressing force is obtainable from the pressure in the low pressure space (S1), for example, in such manner that the high pressure in the high pressure space (S2) is introduced to the low pressure space (S1) through a pressure adjusting valve or the like so that the pressure in the low pressure space (S1) becomes at medium pressure.

It is noted that the above embodiments are substantially preferred examples and are not intended to limit the scope of the present invention, applicable objects thereof, and applicable range thereof.

INDUSTRIAL APPLICABILITY

As described above, the present invention is useful especially for rotary compressors in which the turnover moment is liable to work on an eccentric rotation body such as a piston, a cylinder, and the like.

What is claimed is:

1. A rotary compressor, comprising:

a compression mechanism including a cylinder having a cylinder chamber, a piston accommodated in the cylinder chamber eccentrically with respect to the cylinder, and a blade arranged in the cylinder chamber and defining the cylinder chamber into a first chamber and a second chamber, at least one of the cylinder and the piston rotating eccentrically as an eccentric rotation body;

a drive shaft configured for driving the compression mechanism;

a pressing mechanism configured for bringing a cylinder side end plate, which is provided at one end in an axial direction of the cylinder chamber and faces an end face in an axial direction of the piston, and a piston side end plate, which is provided at the other end in the axial direction of the cylinder chamber and faces an end face in an axial direction of the cylinder, close to each other in an axial direction of the drive shaft; and a casing configured for accommodating the compression mechanism, the drive shaft, and the pressing mechanism, the pressing mechanism generating an axial-direction pressing force with a center of the pressing mechanism being laterally offset from a center rotation axis of the drive shaft, the compression mechanism having a plurality of discharge ports configured for discharging fluid compressed in the cylinder chamber to an outside of the compression mechanism, with the discharge ports being disposed radially outwardly of the center of the pressing mechanism relative to the center rotation axis, and the center of the pressing mechanism being disposed outside a circular path centered on the center rotation axis throughout an entire rotation of the drive shaft, the circular path having a radius equal to a distance between the center rotation axis and an axial center line of the eccentric rotation body as measured perpendicularly with respect to the center rotation axis of the drive shaft, and the center of the pressing mechanism being laterally offset toward the discharge ports away from the circular path.

2. The rotary compressor of claim 1, wherein the cylinder chamber has a circular shape when viewed perpendicularly from the axial direction, and the piston is substantially circular.

3. The rotary compressor of claim 1, wherein the cylinder chamber has an annular shape when viewed perpendicularly from the axial direction, and the piston includes a substantially annular piston arranged in the cylinder chamber and defining the cylinder chamber into an outer cylinder chamber and an inner cylinder chamber.

4. The rotary compressor of claim 3 wherein the piston has a gap dividing the piston into a C-shape with a swing bushing slidably held in the gap, and forming a blade groove configured for holding the blade so as to allow the blade to move back and forth in the swing bushing, and the blade is disposed in the blade groove so as to extend from a wall face on an inner peripheral side to a wall face on an outer peripheral side of the annular cylinder chamber.

5. The rotary compressor of claim 1, wherein the pressing mechanism has a support plate that is arranged along a side of the cylinder side or the piston side end plate of the eccentric rotation body, a sealing ring for defining a first opposing section between the cylinder side or the piston side end plate and the support plate on an inner side in a radial direction and a second opposing section between the cylinder side end plate and the support plate on an outer side in the radial direction, the sealing ring is arranged eccentrically away from a center of the eccentric rotation body in one of the cylinder side end plate, the piston side end plate of the eccentric rotation body and the support plate, and the pressing mechanism allows a fluid pressure discharged outside the compression mechanism to work on the first opposing section.

6. The rotary compressor of claim 5, wherein the sealing ring is fitted in an annular groove formed in one of the eccentric rotation body and the support plate.

7. The rotary compressor of claim 1, wherein the cylinder has a slit that is formed at a portion eccentric from a center of the eccentric rotation body in a face portion opposite a face on a cylinder chamber side of the cylinder side end plate of the eccentric rotation body, and the pressing mechanism allows pressure of fluid discharged outside the compression mechanism to work on the slit.

8. The rotary compressor of claim 1, wherein the cylinder side has a groove and a through hole the groove is formed in a portion eccentric from a center of the eccentric rotation body on a face opposite a face on a cylinder chamber side of the end plate of the eccentric rotation body, the through hole is formed in the cylinder side end plate for allowing the groove to communicate with the cylinder chamber, and the pressing mechanism introduces a portion of fluid compressed in the cylinder chamber into the groove through the through hole to allow a pressure of the fluid to work on the groove.

9. The rotary compressor of claim 1, further comprising:

a sealing mechanism configured and arranged to present leakage of fluid in at least one of a first axial direction gap between an end face in the axial direction of the cylinder and the piston side end plate and a second axial direction gap between an end face in the axial direction of the piston and the cylinder side end plate.

10. The rotary compressor of claim 9, wherein the sealing mechanism includes a tip seal provided at least one of the first axial direction gap and the second axial direction gap.

11. A rotary compressor, comprising:

a compression mechanism including a cylinder having a cylinder chamber, a piston accommodated in the cylinder chamber eccentrically with respect to the cylinder, and a blade arranged in the cylinder chamber and defining the cylinder chamber into a first chamber and a second chamber, at least one of the cylinder and the piston rotating eccentrically as an eccentric rotation body;

a drive shaft configured for driving the compression mechanism;

a pressing mechanism configured for bringing a cylinder side end plate, which is provided at one end in an axial direction of the cylinder chamber and faces an end face in an axial direction of the piston, and a piston side end plate, which is provided at the other end in the axial direction of the cylinder chamber and faces an end face in an axial direction of the cylinder, close to each other in an axial direction of the drive shaft; and a casing configured for accommodating the compression mechanism, the drive shaft, and the pressing mechanism, the pressing mechanism being eccentric away from a center of the cylinder side or the piston side end plate of the eccentric rotation body, the pressing mechanism generating an axial-direction pressing force with a center of the pressing mechanism being eccentric away from a center of the drive shaft, and the cylinder having a slit that is formed at a portion eccentric from a center of the eccentric rotation body in a face portion opposite a face on a cylinder chamber side of the cylinder side end plate of the eccentric rotation body, the slit being disposed on only one radial side of the cylinder relative to the drive shaft and being open in a radially inward direction facing the drive shaft in order to receive pressure of fluid discharged outside the compression mechanism to work on the slit, and the slit being radially spaced from the center of the eccentric rotation body.

* * * * *